US009020383B2

(12) United States Patent
Ishida

(10) Patent No.: US 9,020,383 B2
(45) Date of Patent: Apr. 28, 2015

(54) IMAGE FORMING APPARATUS

(71) Applicant: Konica Minolta, Inc., Tokyo (JP)

(72) Inventor: Yujiro Ishida, Hino (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/956,430

(22) Filed: Aug. 1, 2013

(65) Prior Publication Data

US 2014/0064760 A1 Mar. 6, 2014

(30) Foreign Application Priority Data

Sep. 3, 2012 (JP) ..... 2012-193423

(51) Int. Cl.
*G03G 15/16* (2006.01)
*G03G 15/01* (2006.01)

(52) U.S. Cl.
CPC ..... *G03G 15/1615* (2013.01); *G03G 15/0131* (2013.01)

(58) Field of Classification Search
USPC ..... 399/66, 395; 271/227
See application file for complete search history.

(56) References Cited

U.S. PATENT DOCUMENTS 7,761,015 B2 * 7/2010 Wong ..... 399/27
2007/0001387 A1 * 1/2007 Hamaya et al. ..... 271/227
2008/0232877 A1 * 9/2008 Ishida et al. ..... 399/395
2008/0232878 A1 * 9/2008 Sekine et al. ..... 399/395
2012/0155897 A1 * 6/2012 Torimaru ..... 399/44
2012/0263500 A1 * 10/2012 Saka et al. ..... 399/177

FOREIGN PATENT DOCUMENTS

JP 2002-091185 3/2002
JP 2011-033740 A 2/2011

OTHER PUBLICATIONS

Japanese Office Action, Notification of Reasons for Refusal, Patent Application No. 2012-193423, drafting date: Oct. 10, 2014 and English translation thereof (total of 4 pages).

* cited by examiner

*Primary Examiner* — Clayton E Laballe
*Assistant Examiner* — Warren K Fenwick
(74) *Attorney, Agent, or Firm* — Lucas & Mercanti, LLP

(57) ABSTRACT

An image forming apparatus has an image forming section having a photoreceptor on which a toner image is formed, an endless belt that revolves with its outer surface facing the photoreceptor, a steering roller adapted to provide a tension to the belt and adjust the position of the belt in the width direction, a transfer roller that presses the belt toward the photoreceptor so as to form a transfer nip where the toner image is transferred, a transfer pressure adjusting mechanism adapted to adjust pressing force when the transfer roller presses the belt toward the photoreceptor, and a controller adapted to control the pressing force adjusted by the transfer pressure adjusting mechanism, according to the adjustment state of the steering roller.

6 Claims, 14 Drawing Sheets

FIG. 8

125

| | ANGLE OF STEERING ROLLER (DEGREE) | -2 | -1.6 | -1.2 | -0.8 | -0.4 | 0 | 0.4 | 0.8 | 1.2 | 1.6 | 2 |
|---|---|---|---|---|---|---|---|---|---|---|---|---|
| ANGLE OF PRIMARY TRANSFER PRESSURE ADJUSTING CAM (DEGREE) | Y | -120 | -96 | -58 | -23 | -5 | 0 | 5 | 23 | 58 | 96 | 120 |
| | M | -72 | -58 | -35 | -14 | -3 | 0 | 3 | 14 | 35 | 58 | 72 |
| | C | 15 | 15 | 15 | 15 | 15 | 0 | 15 | 15 | 15 | 15 | 15 |
| | K | 72 | 58 | 35 | 14 | 3 | 0 | -3 | -14 | -35 | -58 | -72 |

IMAGE FORMING APPARATUS

CROSS REFERENCE TO RELATED APPLICATIONS

The present invention contains subject matter related to Japanese Patent Application JP 2012-193423 filed in the Japanese Patent Office on Sep. 3, 2012, the entire contents of which being incorporated herein by reference.

BACKGROUND OF THE INVENTION

1. Field of the Invention

The present invention relates to an image forming apparatus having a belt-like conveying section, a belt-like intermediate transfer body, and the like.

2. Description of the Related Art

Conventionally, there has been known an image forming apparatus adapted to form a color image. Such image forming apparatus has four image forming units for forming a toner image of yellow (Y), a toner image of magenta (M), a toner image of cyan (C), and a toner image of black (K). In each image forming unit, a photoreceptor is electrically-charged and then the electrical charges are erased according to a document image (i.e., the photoreceptor is so-called exposed), so that an electrostatic latent image is formed on the photoreceptor. Further, a developing section is used to cause the toner to adhere to the electrostatic latent image of the photoreceptor, so that a toner image is formed on the photoreceptor.

The toner adhering to the photoreceptor of each image forming unit is primarily transferred to, for example, a belt-like intermediate transfer body and then secondarily transferred to a sheet. The intermediate transfer body (sometimes referred to as "belt" hereinafter) is wrapped around a plurality of rollers. It is preferred that when transferring toner, a suitable transfer nip is formed between the photoreceptor and the belt-like intermediate transfer body.

Japanese Unexamined Patent Application Publication No. 2011-33740 discloses an art in which, in order to suppress separation of an intermediate transfer belt from image carriers to thereby prevent primary transfer failure and obtain a high-quality image, the transfer nip between the intermediate transfer belt and each of the image carriers is provided with a clown-like pressing member on the downstream side at a position near the transfer nip. By using the pressing member to press the intermediate transfer belt toward the side of each image carrier, the primary transfer pressure near the center of the intermediate transfer belt in the width direction can be prevented from dropping even in the case where two ends of the primary transfer roller in the axial direction are pressed toward the image carrier by a spring or the like. Thus, it is possible to form a transfer nip having a uniform primary transfer pressure in the axial direction of the primary transfer roller.

SUMMARY OF THE INVENTION

In the image forming apparatus having the aforesaid intermediate transfer belt, for example, a steering control of the intermediate transfer belt is performed so that the intermediate transfer belt is located in appropriate position with respect to the photoreceptor. To be specific, the attitude of the steering roller, around which the intermediate transfer belt is wrapped, is changed so as to change the tension of the belt, so that the position of the belt relative to the photoreceptor is adjusted to appropriate position. However, when performing steering operation of the intermediate transfer belt, if there is a difference in tension between the proximal side and the distal side in the width direction of the intermediate transfer belt, it will be difficult to keep the width and pressure of the transfer nip between the intermediate transfer belt and the photoreceptor uniform. As a result, toner concentration difference in the width direction of the intermediate transfer belt will be caused in the toner image transferred to the intermediate transfer belt.

The present invention is made to solve the aforesaid problems, and at least one object of the present invention is to make it possible to keep the transfer pressure in the width direction of the belt uniform even in a state where, due to the steering operation of the belt, the belt tension near the photoreceptor becomes non-uniform between the proximal side and the distal side, for example.

To achieve the aforesaid object, an image forming apparatus according to an aspect of the present invention comprises: an image forming section having a photoreceptor on which a toner image is formed; an endless belt that revolves with its outer surface facing the photoreceptor; a steering roller adapted to provide a tension to the belt and adjust the position of the belt in the width direction; a transfer roller that presses the belt toward the photoreceptor so as to form a transfer nip where the toner image is transferred; a transfer pressure adjusting mechanism adapted to adjust pressing force when the transfer roller presses the belt toward the photoreceptor; and a controller adapted to control the pressing force adjusted by the transfer pressure adjusting mechanism, according to the adjustment state of the steering roller.

With such a configuration, the movement amount of the transfer roller moved by the transfer pressure adjusting mechanism is controlled according to the adjustment state (the attitude) of the steering roller. In other words, the position of the transfer roller when the transfer roller presses the belt toward the photoreceptor is moved according to the adjustment state (the attitude) of the steering roller. By suitably setting the movement amount of the transfer roller moved by the transfer pressure adjusting mechanism, the pressing force of the transfer roller when the transfer roller presses the belt toward the photoreceptor is suitably adjusted, so that the transfer pressure between the belt and the photoreceptor is kept uniform in the width direction of the belt. Thus, the toner concentration difference of the transfer nip in the width direction of the belt can be controlled to be equal to or lower than a predetermined value.

BRIEF DESCRIPTION OF THE DRAWINGS

FIG. 8 shows an example of the correction table to be referred to when the image forming apparatus according to the first embodiment of the present invention performs primary transfer;

DETAILED DESCRIPTION OF THE PREFERRED EMBODIMENT(S)

Figure 1:
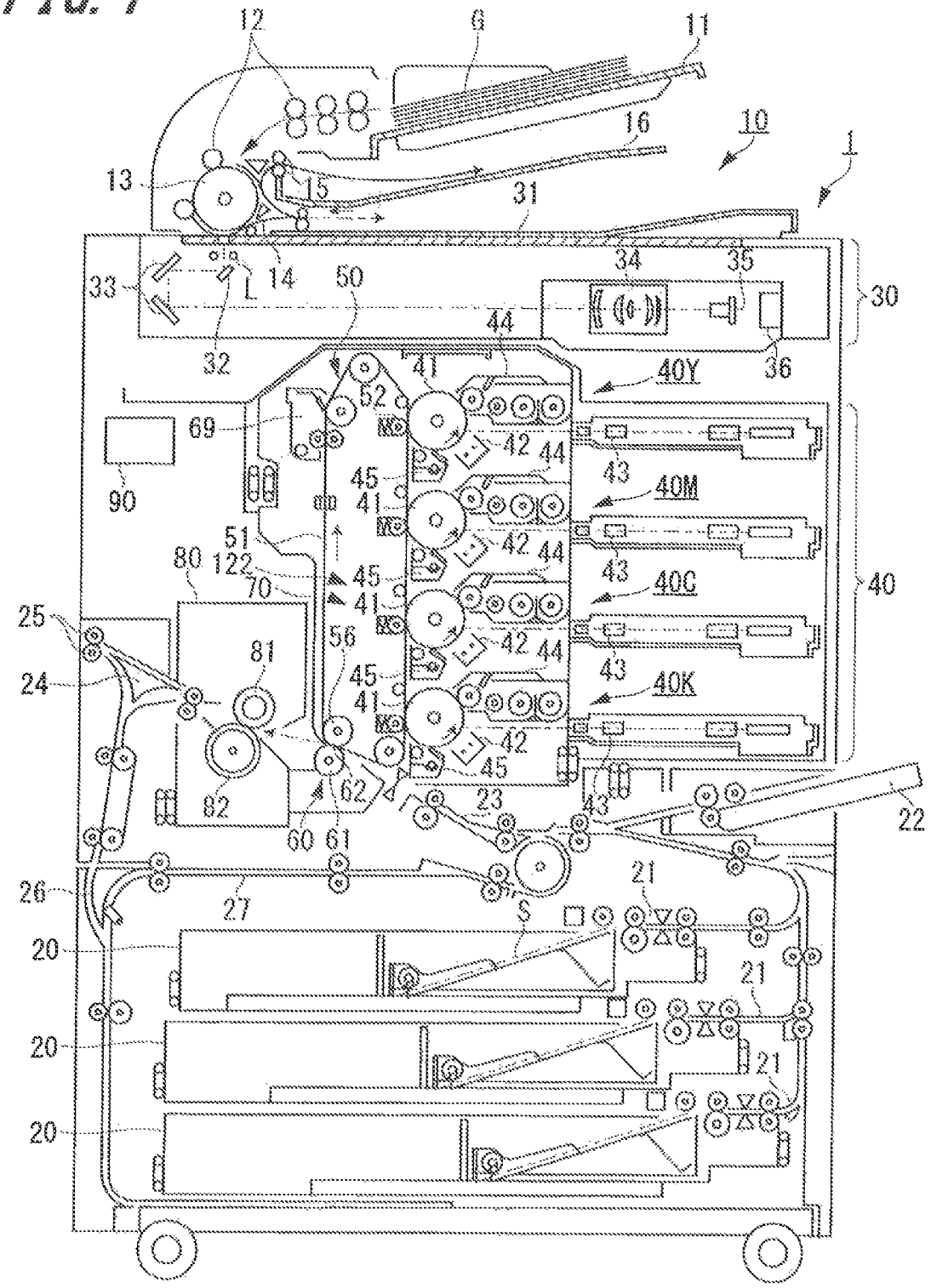
FIG. 1 is a view showing the overall configuration of an image forming apparatus according to a first embodiment of the present invention.

Embodiments for carrying out the present invention will be described below with reference to the attached drawings.

The description will be given in the following order. Note that, in the attached drawings, like components are denoted by like reference numerals, and the explanation thereof will not be repeated.

1. First embodiment (an example in which the movement of primary transfer rollers is controlled according to amount of steering operation)

2. Second embodiment (an example in which an intermediate transfer unit is provided with a pressing roller)

1. First Embodiment

Configuration Example of Image Forming Apparatus

First, a configuration example of an image forming apparatus of according to a first embodiment will be described below with reference to FIG. 1.

FIG. 1 is a view showing the overall configuration of an image forming apparatus 1 according to a first embodiment of the present invention.

As shown in FIG. 1, the image forming apparatus 1 is adapted to form an image on a sheet based on electrophotographic technology. The image forming apparatus 1 is a tandem type color image forming apparatus, in which four colors of toner, which are yellow (Y), magenta (M), cyan (C), and black (K), are superimposed one on top of another. The image forming apparatus 1 includes a document conveying section 10, a plurality of sheet accommodating sections 20, an image reading section 30, an image forming section 40, an intermediate transfer unit 50, a secondary transfer section 60, a fixing section 80, and a control board 90.

The document conveying section 10 includes a document feeding table 11 for setting a document G, a plurality of rollers 12, a conveying drum 13, a conveying guide 14, a document ejecting roller 15, and a document receiving tray 16. The document G set on the document feeding table 11 is conveyed page by page to a reading position of the image reading section 30 by the plurality of rollers 12 and the conveying drum 13. The conveying guide 14 and the document ejecting roller 15 eject the document G conveyed by the plurality of rollers 12 and the conveying drum 13 to the document receiving tray 16.

The image reading section 30 reads the image of the document G conveyed by the document conveying section 10 or the image of a document placed on a platen 31, and creates image data. To be specific, the image of the document G is irradiated by a lamp L. The light reflected from the document G is guided to a first mirror unit 32, a second mirror unit 33 and a lens unit 34 in that order, so as to form an image on a light receiving surface of an image pickup device 35. The image pickup device 35 photoelectrically converts the light incident thereon and outputs a prescribed image signal. The image signal outputted by the image pickup device 35 is A/D converted to thereby create image data.

The image reading section 30 has an image reading control section 36. The image reading control section 36 performs various processing, such as shading correction, dither processing, compression and/or the like, on the image data created by the A/D conversion, and stores the resultant data in a RAM 103 (see FIG. 6) of the control board 90. Incidentally, the image data is not limited to the data outputted from the image reading section 30, but may be data received from an external device (such as a personal computer, another image forming apparatus or the like) connected to the image forming apparatus 1.

The plurality of sheet accommodating sections 20 are arranged in the lower portion of the main body of the apparatus, and the number of the sheet accommodating sections 20 is determined according to the sizes and/or kinds of sheets S. The sheet S is fed by a sheet feeding section 21 and conveyed to a conveying section 23, and is then conveyed to the secondary transfer section 60 (which is the transfer position) by the conveying section 23. Further, a manual sheet feeding section 22 is arranged in the vicinity of the sheet accommodating sections 20. A specialty sheet, such as a sheet of a size not accommodated in the sheet accommodation section 20, a tag sheet having a tag, an OHP sheet or the like, is sent to the transfer position from the manual sheet feeding section 22.

The image forming section 40 and the intermediate transfer unit 50 are arranged between the image reading section 30 and the sheet accommodating section 20. The image forming section 40 has four image forming units 40Y, 40M, 40C, 40K for forming a toner image of yellow (Y), a toner image of magenta (M), a toner image of cyan (C), and a toner image of black (K).

To be specific, the first image forming unit 40Y forms a toner image of yellow, the second image forming unit 40M forms a toner image of magenta, the third image forming unit 40C forms a toner image of cyan, and the fourth image forming unit 40K forms a toner image of black. Since the four image forming units 40Y, 40M, 40C, 40K have the same configuration, only the first image forming unit 40Y will be described herein.

The first image forming unit 40Y has a drum-like photoreceptor 41, a charging section 42 arranged around the photoreceptor 41, an exposure section 43, a developing section 44, and a cleaning section 45. The photoreceptor 41 is rotated by a drive motor (not shown). The charging section 42 applies electric charges to the photoreceptor 41 so that the surface of the photoreceptor 41 is evenly charged. The exposure section 43 performs an exposure operation on the surface of the photoreceptor 41 on the basis of the image data based on the content read from the document G or the image data transmitted from the external device, to thereby form an electrostatic latent image on the photoreceptor 41.

The developing section 44 develops the electrostatic latent image formed on the photoreceptor 41 using the toner. To be specific, the developing section 44 causes yellow toner to adhere to the electrostatic latent image formed on the photoreceptor 41, and thereby a toner image of yellow is formed on the surface of the photoreceptor 41.

Incidentally, the developing section 44 of the second image forming unit 40M causes the magenta toner to adhere to the photoreceptor 41 of the second image forming unit 40M, the developing section 44 of the third image forming unit 40C causes the cyan toner to adhere to the photoreceptor 41 of the third image forming unit 40C, and the developing section 44 of the fourth image forming unit 40K causes the black toner to adhere to the photoreceptor 41 of the fourth image forming unit 40K.

The cleaning section 45 removes the toner remaining on the surface of the photoreceptor 41.

The toner adhering to the photoreceptor 41 is transferred to an intermediate transfer belt 51 of the intermediate transfer unit 50. The intermediate transfer unit 50 includes the intermediate transfer belt 51 (which is a concrete example of an intermediate transfer body) and a plurality of rollers around which the intermediate transfer belt 51 is wrapped. The intermediate transfer belt 51 is driven by a drive motor (not shown) to rotate in a direction opposite to the rotation (moving) direction of the photoreceptor 41.

In the intermediate transfer belt 51, four primary transfer rollers 52 are arranged in positions facing the respective photoreceptors 41 of the four image forming units 40Y, 40M, 40C, 40K. Each primary transfer roller 52 applies a voltage having a polarity opposite to that of toner to the intermediate transfer belt 51, to thereby transfer the toner adhering on the photoreceptor 41 to the intermediate transfer belt 51.

Thus, by rotationally driving the intermediate transfer belt 51, four toner images respectively formed by the four image forming units 40Y, 40M, 40C, 40K are sequentially transferred to the surface of intermediate transfer belt 51. Consequently, a toner image of yellow, a toner image of magenta, a toner image of cyan, and a toner image of black are superimposed on the intermediate transfer belt 51 to thereby form a color image.

Further, a belt cleaning device 69 faces the intermediate transfer belt 51. The belt cleaning device 69 cleans the surface of the intermediate transfer belt 51 that has finished transferring the toner image to the sheet S.

The secondary transfer section 60 is arranged near the intermediate transfer belt 51 and on the downstream side of the conveying section 23 in the sheet conveying direction. The secondary transfer section 60 causes the sheet S conveyed by the conveying section 23 to contact the intermediate transfer belt 51, so that the toner image formed on the outer surface of the intermediate transfer belt 51 is transferred to the sheet S.

The secondary transfer section 60 has a secondary transfer roller 61. The secondary transfer roller 61 is brought into pressure contact with a counter roller 56, which is one of the plurality of rollers of the intermediate transfer unit 50. The contact portion between the secondary transfer roller 61 and the intermediate transfer belt 51 becomes a secondary transfer nip 62. The secondary transfer nip 62 is the transfer position where the toner image formed on the outer surface of the intermediate transfer belt 51 is transferred to the sheet S.

The fixing section 80 is arranged on the sheet S ejection side of the secondary transfer section 60. The fixing section 80 presses and heats the sheet S to fix the transferred toner image to the sheet S. The fixing section 80 is configured by, for example, an upper fixing roller 81 and a lower fixing roller 82, which are a pair of fixing members. The upper fixing roller 81 and the lower fixing roller 82 are arranged in a state where they are brought into pressure contact with each other, so that a fixing nip is formed as a pressure-contact portion between the upper fixing roller 81 and the lower fixing roller 82.

A heater is provided within the upper fixing roller 81. A roller portion of the upper fixing roller 81 is heated by the heat radiated from the heater. The heat of the roller portion of the upper fixing roller 81 is transferred to the sheet S, and thereby the toner image on the S is heat-fixed.

The sheet S is conveyed so that the surface having the toner image transferred thereto by the secondary transfer section 60 (i.e., the surface to be subjected to heat-fixing) faces the upper fixing roller 81, and passes through the fixing nip. Thus, when the sheet S passing through the fixing nip is pressed by the upper fixing roller 81 and the lower fixing roller 82, it is heated by the roller portion of the upper fixing roller 81.

A switching gate 24 is arranged on the downstream side of the sheet conveying direction of the fixing section 80. The switching gate 24 switches the conveying path of the sheet S passed through the fixing section 80. To be specific, when ejecting the sheet S with the image side facing up in the case of forming an image on one side of the sheet S, the switching gate 24 will cause the sheet S to go straight ahead. Therefore, the sheet S is ejected by a pair of sheet ejecting rollers 25. Further, when ejecting the sheet S with the image side facing down in the case of forming image on one side of the sheet S, or when forming images on both sides of the sheet S, the switching gate 24 will guide the sheet S downward.

Further, when ejecting the sheet S with the image side facing down, after the sheet S has been guided downward by the switching gate 24, the sheet S will be reversed and conveyed upward by the sheet reversing and conveying section 26. Therefore, the reversed sheet S is ejected by the pair of sheet ejecting rollers 25.

When forming images on both sides of the sheet S, after the sheet S has been guided downward by the switching gate 24, the sheet S will be reversed by the sheet reversing and conveying section 26 and sent to the transfer position again by a sheet re-feeding path 27.

Alternatively, a post-processing device may be arranged on the downstream side of the pair of the sheet ejecting rollers 25, wherein the post-processing device is adapted to perform folding processing, stapling processing and the like on the sheet S.

[Intermediate Transfer Unit]

Next, the plurality of rollers of the intermediate transfer unit 50 will be described below with reference to FIGS. 2 and 3.

Figure 2:
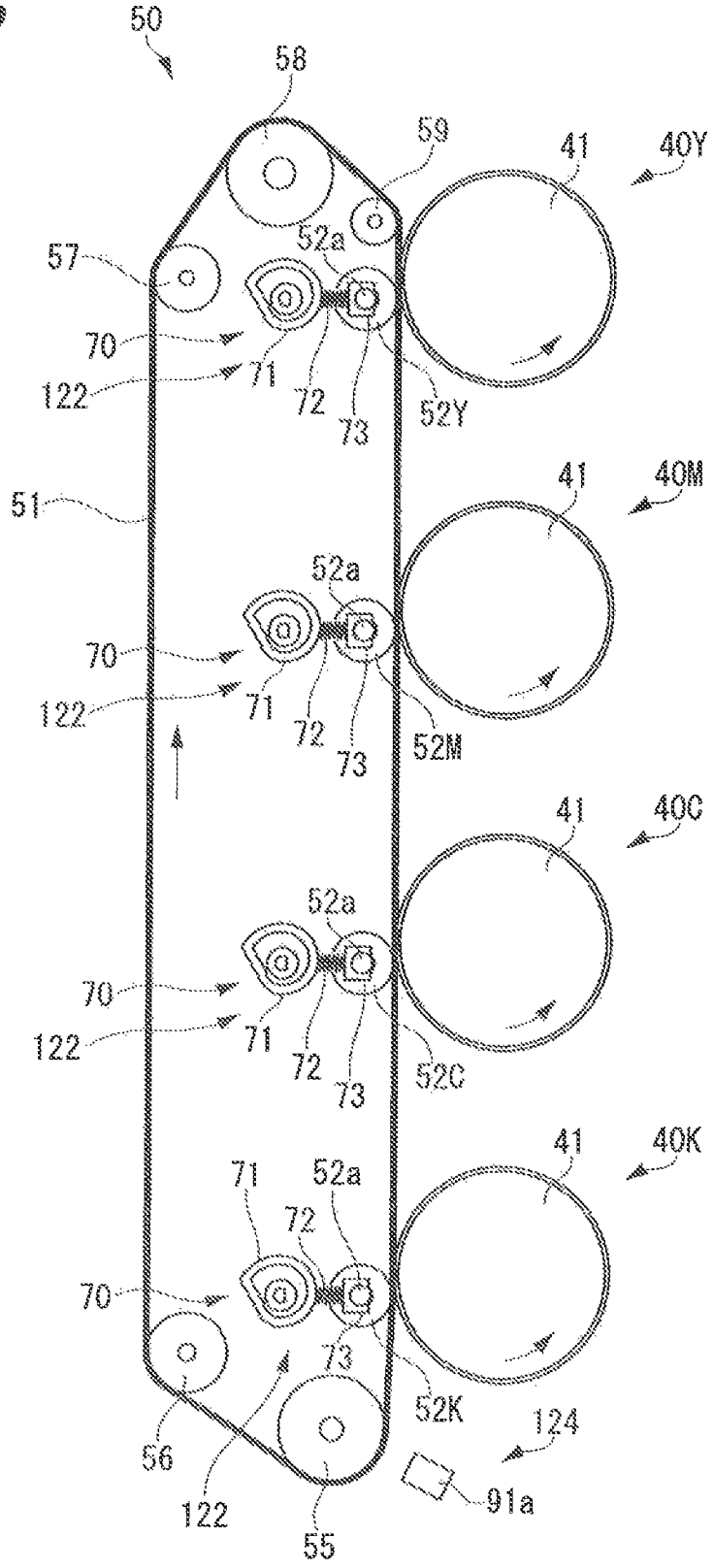
FIG. 2 is a schematic elevational view of an intermediate transfer unit of the image forming apparatus according to the first embodiment of the present invention.
Figure 3:
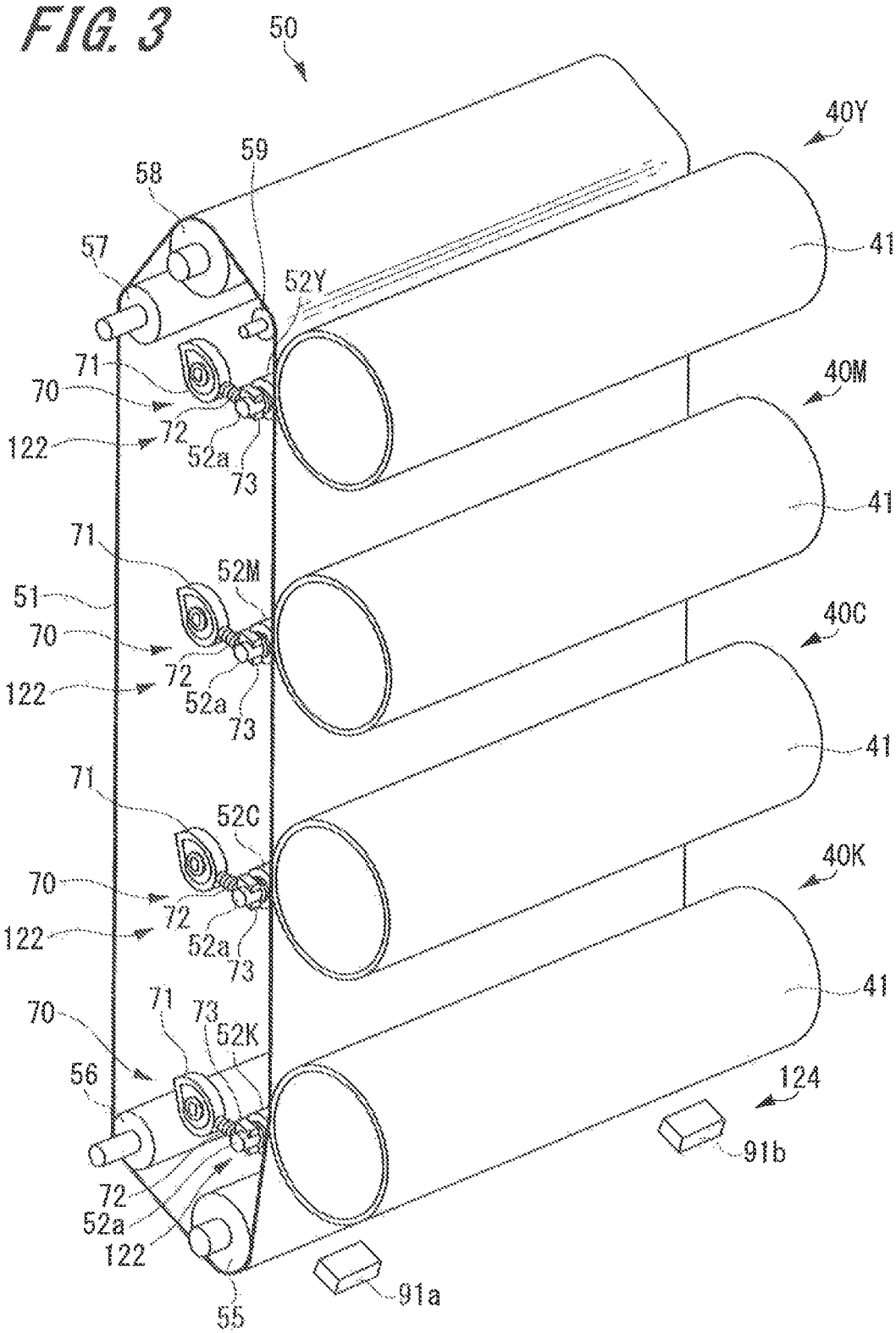
FIG. 3 is a schematic perspective view of the intermediate transfer unit of the image forming apparatus according to the first embodiment of the present invention.

FIG. 2 is a schematic elevational view of the intermediate transfer unit 50. FIG. 3 is a schematic perspective view of the intermediate transfer unit 50. As an example, FIGS. 2 and 3 show a state in which the tilt angle of a steering roller shown in a correction table 125 (see FIG. 8), which is to be described later, is 0 degree.

As shown in FIG. 2, the plurality of rollers of the intermediate transfer unit 50 mainly include a drive roller 55, the aforesaid counter roller 56, a driven roller 57, a steering roller 58, and a driven roller 59. The intermediate transfer belt 51 which is wrapped around the drive roller 55, the counter roller 56, the driven roller 57, the steering roller 58 and the driven roller 59 has a long circular shape whose length in up-down direction is up to 500 mm, for example.

The plurality of primary transfer rollers 52 provided on the inner side of the intermediate transfer belt 51 are composed of four primary transfer rollers 52Y, 52M, 52C, 52K. The primary transfer roller 52Y faces the photoreceptor 41 of the first image forming unit 40Y with the intermediate transfer belt 51 sandwiched in between, the primary transfer roller 52M faces the photoreceptor 41 of the second image forming unit 40M with the intermediate transfer belt 51 sandwiched in between, the primary transfer roller 52C faces the photoreceptor 41 of the third image forming unit 40C with the intermediate transfer belt 51 sandwiched in between, and the primary transfer roller 52K faces the photoreceptor 41 of the fourth image forming unit 40K with the intermediate transfer belt 51 sandwiched in between.

The drive roller 55 is arranged on the downstream side of the primary transfer roller 52K, and is rotatably supported by a roller supporter (not shown), wherein the primary transfer roller 52K is located on the most downstream side in the moving direction of the intermediate transfer belt 51. The drive roller 55 is rotated by a drive roller rotating mechanism 121 (see FIG. 6). When the drive roller 55 is rotated, the intermediate transfer belt 51 will be driven so as to rotate in a direction opposite to the rotational direction of the photoreceptor 41.

The counter roller 56 is arranged on the downstream side of the drive roller 55, and is rotatably supported by a roller supporter (not shown). The counter roller 56 faces the secondary transfer roller 61 (see FIG. 1) with the intermediate transfer belt 51 sandwiched in between. The driven roller 57 is arranged on the upper side (i.e., the downstream side) of the counter roller 56, and is rotatably supported by a roller supporter (not shown).

The steering roller 58 is arranged on the downstream side of the driven roller 57 but on the upstream side of the primary transfer roller 52Y, which is located on the most upstream side in the moving direction of the intermediate transfer belt 51 among the plurality of primary transfer rollers 52. The driven roller 59 is arranged between the primary transfer roller 52Y and the steering roller 58, and is rotatably supported by a roller supporter (not shown). The steering roller 58 will be described later in more detail with reference to FIG. 5.

Four primary transfer pressure adjusting mechanisms 122 (as an example of transfer pressure adjusting mechanisms) are arranged on the inner side of the intermediate transfer belt 51. The four primary transfer pressure adjusting mechanisms 122 are adapted to move the four primary transfer rollers 52Y, 52M, 52C, 52K. Since the four primary transfer pressure adjusting mechanisms 122 respectively corresponding to the four primary transfer rollers 52Y, 52M, 52C, 52K have the same configuration, herein only the primary transfer pressure adjusting mechanism 122 corresponding to the primary transfer roller 52Y will be described.

[Primary Transfer Pressure Adjusting Mechanism]

Figure 4:
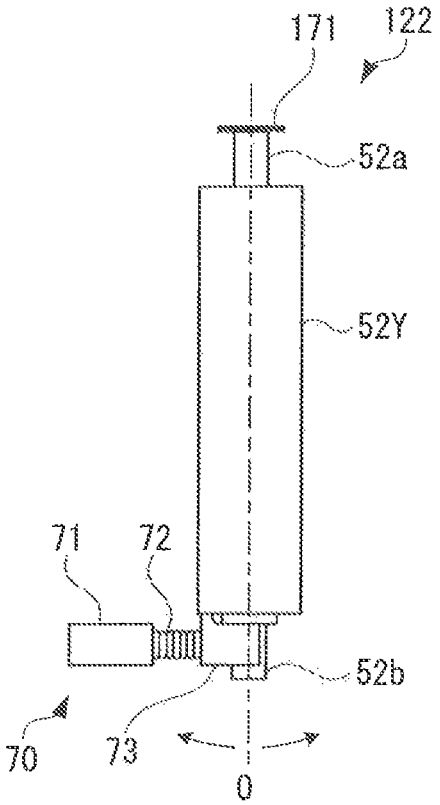
FIG. 4 is a schematic top view showing a configuration example of a primary transfer pressure adjuster corresponding to a primary transfer roller (yellow (Y)) according to the first embodiment of the present invention.

FIG. 4 is a schematic top view showing a configuration example of the primary transfer pressure adjusting mechanism 122.

One end 52*a* of a rotating shaft of the primary transfer roller 52Y is rotatably supported by a roller supporting member 171. The primary transfer pressure adjusting mechanism 122 includes a roller supporting member 171, a moving unit (not shown), and a primary transfer pressure adjuster 70, wherein the roller supporting member 171 rotatably supports the primary transfer roller 52Y, and the moving unit is adapted to move the roller supporting member 171.

A configuration obtained by combining a motor and various mechanisms, or one of various actuators may be used as the moving unit.

The moving unit of the primary transfer pressure adjusting mechanism 122 is controlled by a controller 100 (see FIG. 6), which is to be described later. The controller 100 drive-controls the moving unit of the primary transfer pressure adjusting mechanism 122 to move the primary transfer roller 52Y to a preset position.

The primary transfer pressure adjuster 70 is adapted to adjust the transfer pressure (the primary transfer pressure) of a primary transfer nip formed between the intermediate transfer belt 51 pressed by the primary transfer roller 52Y and the photoreceptor 41 of the first image forming unit 40Y.

[Primary Transfer Pressure Adjuster]

The primary transfer pressure adjuster 70 arranged with respect to the primary transfer roller 52Y includes a primary transfer pressure adjusting cam 71, a biasing member 72 (such as a spring member or the like), a gripper 73, and a drive section (not shown).

In the present embodiment, the primary transfer pressure adjusting cam 71 is configured by an eccentric cam in which the distance between the rotating axis and the outer peripheral surface thereof (i.e., the radius thereof) continuously increases when the cam rotates right (i.e., when the cam rotates in a positive direction). The position (the angle) of the primary transfer pressure adjusting cam 71 is changed, under the control of the controller 100, according to the attitude (i.e., the tilt angle) of the steering roller 58. Thus, in a predetermined attitude of the steering roller 58, the pressing force of the primary transfer roller 52Y is adjusted, so that the primary transfer pressure is adjusted to a constant value. Incidentally, although the present embodiment is described based on an example in which an eccentric cam whose radius increases when rotating right (i.e., when rotating in a positive direction) is used as the primary transfer pressure adjusting cam 71, obviously a cam having an inverted structure or other structure may also be used as the primary transfer pressure adjusting cam 71.

An elastic body such as a spring member is used as the biasing member 72. One end of the biasing member 72 abuts the outer peripheral surface of the primary transfer pressure adjusting cam 71, and the other end of the biasing member 72 is fixed to one surface of the gripper 73.

The gripper 73 has a hole through which the other end 52*b* of the rotating shaft of the primary transfer roller 52Y is inserted, wherein the other end 52*b* is formed on the opposite side to the one end 52*a* of the rotating shaft of the primary transfer roller 52Y. The other end 52*b* of the rotating shaft of the primary transfer roller 52Y is gripped by the gripper 73 so that the primary transfer roller 52Y not only can rotate with the rotating shaft as the center, but also can swing with the one end 52*a* of the rotating shaft as the supporting point. As shown in FIGS. 3 and 4, the hole of the gripper 73 may have a notch formed in a part thereof.

When the primary transfer pressure adjusting cam 71 is rotated with the rotating axis thereof as the rotation center by a drive section (not shown) such as a motor, the distance (the radius) between the rotation center thereof and the outer peripheral surface where the cam abuts the biasing member 72 will change. The stroke of the biasing member 72 changes depending on the change of the radius of the primary transfer pressure adjusting cam 71. Due to the elastic force of the biasing member 72, the primary transfer roller 52Y is pressed in the horizontal direction, so that the primary transfer roller 52Y is moved toward the side of the photoreceptor 41 of the first image forming unit 40Y, wherein the elastic force of the biasing member 72 changes according to the stroke of the biasing member 72.

Incidentally, although the present embodiment is described based on an example in which the primary transfer pressure adjusting mechanism 122 includes the primary transfer pressure adjuster 70 and the moving unit (not shown) such as a motor, the present invention is not limited to such example. In other words, the configuration of the primary transfer pressure adjusting mechanism 122 is not particularly limited as long as it changes the tilt of the rotating shaft of the primary transfer roller 52 relative to the width direction of the intermediate transfer belt 51.

For example, the primary transfer pressure adjusting mechanism 122 may also be configured by a motor and a rack and pinion mechanism, wherein the motor is adapted to rotate the pinion of the rack and pinion mechanism. Further, the primary transfer pressure adjusting mechanism 122 may also be configured by a belt, a pulley wrapped by the belt, and a motor for rotating the pulley. Other mechanism that cause the primary transfer rollers 52Y, 52M, 52C, 52K to swing may be used as the primary transfer pressure adjusting mechanism 122. Further, other actuators that cause the primary transfer rollers 52Y, 52M, 52C, 52K to swing, such as an air cylinder, a linear actuator or the like, may also be used as the primary transfer pressure adjusting mechanism 122.

In the present embodiment, for example, a position (an angle) where the radius of the primary transfer pressure adjusting cam 71 becomes the maximum value is defined as a "plus-side limit position", a position (an angle) where the radius of the primary transfer pressure adjusting cam 71 becomes the minimum value is defined as a "minus-side limit position", and a position where the radius of the primary transfer pressure adjusting cam 71 becomes the intermediate value between the maximum value and the minimum value is defined as 0 degree. As shown in FIG. 4, when the angle of the primary transfer pressure adjusting cam 71 is 0 degree, the rotating shaft of the primary transfer roller 52Y becomes a reference position O which is substantially parallel to the width direction of the intermediate transfer belt 51. However, the setting described above is merely an example, and the present invention is not limited to such example.

The primary transfer pressure of the intermediate transfer belt 51 in the width direction is adjusted by changing the tilt (the direction of the tilt and the magnitude of the tilt) of the rotating shaft of the primary transfer roller 52Y from the reference position O. Thus, toner concentration of the toner image transferred from the photoreceptor 41 to the intermediate transfer belt 51 is adjusted, so that toner concentration difference (i.e., toner concentration gradient) is eliminated. For example, as shown in FIG. 4, by fixing the one end 52*a* of the rotating shaft of the primary transfer roller 52Y and tilting the other end 52*b* of the rotating shaft of the primary transfer roller 52Y to the right, the primary transfer pressure on the proximal side increases, and therefore the toner concentration of the intermediate transfer belt 51 on the proximal side becomes relatively high and the toner concentration on the distal side becomes relatively low. Conversely, by tilting the other end 52*b* of the rotating shaft of the primary transfer roller 52Y to the left, the primary transfer pressure on the proximal side decreases, and therefore the toner concentration of the intermediate transfer belt 51 on the proximal side becomes relatively low and the toner concentration on the distal side becomes relatively high.

In the primary transfer pressure adjusting mechanism 122, the primary transfer roller 52Y is moved close to and far away from the photoreceptor 41 of the first image forming unit 40Y by the moving unit (not shown), through the intermediate transfer belt 51.

When the primary transfer roller 52Y is moved close to the photoreceptor 41 of the first image forming unit 40Y, the primary transfer roller 52Y is brought into contact with the inner surface of the intermediate transfer belt 51. Further, the primary transfer roller 52Y presses the inner surface of the intermediate transfer belt 51 to cause the outer surface of the intermediate transfer belt 51 to contact with the photoreceptor 41 of the first image forming unit 40Y.

For example, during the time when the image forming apparatus 1 (see FIG. 1) is not forming an image on the sheet S, the primary transfer pressure adjusting mechanism 122 sets the attitude of the intermediate transfer belt 51 to a "released state". In other words, the primary transfer roller 52Y is located in a "separated position", which is a position where the primary transfer roller 52Y is separated from the photoreceptor 41 of the first image forming unit 40Y by a predetermined distance. Thus, the primary transfer roller 52Y is separated from the inner surface of the intermediate transfer belt 51, and the intermediate transfer belt 51 is separated from the photoreceptor 41 of the first image forming unit 40Y.

In such a manner, the position of the primary transfer roller 52Y is switched by the moving unit of the primary transfer pressure adjusting mechanism 122 between the aforesaid "separated position" where the intermediate transfer belt 51 does not contact the corresponding photoreceptor 41 and a "nearby position" where the intermediate transfer belt 51 contacts the corresponding photoreceptor 41.

Similarly, the positions of the primary transfer rollers 52M, 52C, 52K are respectively switched between the "separated positions" where the intermediate transfer belt 51 does not contact the three corresponding photoreceptors 41 and the "nearby positions" where the intermediate transfer belt 51 contacts the three corresponding photoreceptors 41.

Further, when the primary transfer nip is formed between the intermediate transfer belt 51 and the photoreceptor 41 of the first image forming unit 40Y, the primary transfer pressure of the primary transfer nip is adjusted by rotating the primary transfer pressure adjusting cam 71 to a suitable position. The operating amount (i.e., the rotation angle) of the primary transfer pressure adjusting cam 71 is determined according to the attitude (i.e., the tilt angle) of the steering roller 58 (see FIG. 5), which is to be described later.

Similarly, the operating amount of the primary transfer pressure adjusting cams 71 corresponding to the primary transfer rollers 52M, 52C, 52K is also determined according to the attitude of the steering roller 58.

Both the adjustment of the position of the primary transfer rollers 52Y, 52M, 52C, 52K and the adjustment of the primary transfer pressure performed by the primary transfer pressure adjusting cams 71 corresponding to the primary transfer rollers 52Y, 52M, 52C, 52K are independently controlled for each of the primary transfer rollers 52Y, 52M, 52C, 52K. Incidentally, in the example shown in FIGS. 2 and 3, the primary transfer rollers 52Y, 52M, 52C, 52K are in the same position (i.e., the same angle).

[Toner Concentration Difference Detector]

A toner concentration difference detector 124 is arranged on the downstream side in the moving direction of the intermediate transfer belt 51 at a position near the photoreceptor 41 of the fourth image forming unit 40K, wherein the photoreceptor 41 of the fourth image forming unit 40K is located on the most downstream side among the four photoreceptors 41. The toner concentration difference detector 124 is adapted to create data (such as a correction table, for example) to be referred to when adjusting the primary transfer pressure of the primary transfer nip formed between the photoreceptor 41 and the intermediate transfer belt 51.

In an example, the toner concentration difference detector 124 includes two toner detectors 91*a*, 91*b*. The toner detector 91*a* is arranged on the proximal side in the width direction of the intermediate transfer belt 51, and the toner detector 91*b* is arranged on the distal side in the width direction of the intermediate transfer belt 51. The toner detector 91*a* and the toner detector 91*b* respectively detect the toner concentration of the toner image transferred from the four photoreceptors 41 to the intermediate transfer belt 51, and output the detection result to the controller 100 (see FIG. 6), which is to be described later. In the case where the toner concentration difference detector 124 is arranged on the downstream side of the photoreceptor 41 of the fourth image forming unit 40K (see FIG. 2), since the toner concentration of the toner image immediately after primary transfer is detected, information about the toner concentration difference in the width direction of the intermediate transfer belt 51 immediately after primary transfer can be acquired.

As an example, a reflective photosensor may be used as each of the toner detectors 91*a*, 91*b*. The reflective photosensor includes a reflective light source and a light receiving element. The reflective light source and the light receiving element are provided on one side of the intermediate transfer belt 51 where the toner image is formed, and is arranged so as to face the intermediate transfer belt 51. The light irradiated from the reflective light source to the intermediate transfer belt 51 is reflected either by the surface of the intermediate transfer belt 51 or by the toner transferred to the intermediate transfer belt 51, and the reflected light is received by the light-receiving element. The amount of the reflected light received by the light-receiving element differs depending on the residual amount of the toner. A signal corresponding to the amount of the reflected light is outputted from the reflective photosensor.

As another example, a transmissive photosensor may be used as each of the toner detectors 91*a*, 91*b*. The transmissive photosensor includes a transmissive light source and a light-receiving element adapted to detect the light from the transmissive light source. The transmissive light source and the light-receiving element face each other with the intermediate transfer belt 51 sandwiched in between. In the case where the transmissive photosensor is used, the intermediate transfer belt 51 needs to be formed of a material which is transmissive with respect to the wavelength of the light from the transmissive light source.

It is preferred that a LED (Light Emitting Diode) is used as the reflective light source or the transmissive light source. Further, the wavelength of the light from the transmissive light source is such that the light can be transmitted by the intermediate transfer belt 51.

Incidentally, although the present embodiment is described based on a configuration in which the toner concentration difference detector 124 detects the toner concentration of the toner image transferred to the intermediate transfer belt 51, the present invention also includes a configuration in which the toner concentration difference detector 124 detects the toner concentration of a toner image transferred to the sheet. In the case where the toner concentration difference detector 124 detects the toner concentration of a toner image transferred to the sheet, the toner concentration difference detector 124 is arranged, for example, on the downstream side of the secondary transfer section 60.

For example, the toner concentration difference detector 124 may also be arranged between the secondary transfer section 60 and the fixing section 80. In such a case, the toner concentration difference detector 124 detects the toner concentration difference of the toner image transferred to the sheet S by passing through the secondary transfer section 60. With such a configuration, the user can compare the toner concentration difference of the toner image transferred to the sheet with the toner concentration difference calculated based on the detection result of the toner concentration difference detector 124. Further, the comparison result obtained based on the visual judgment of the user can be used, for example, to adjust the primary transfer pressure, and/or to be reflected in the correction table and the like adapted to be referred to when adjusting the primary transfer pressure.

[Steering Roller]

Next, the steering roller 58 will be described below with reference to FIG. 5.

Figure 5:
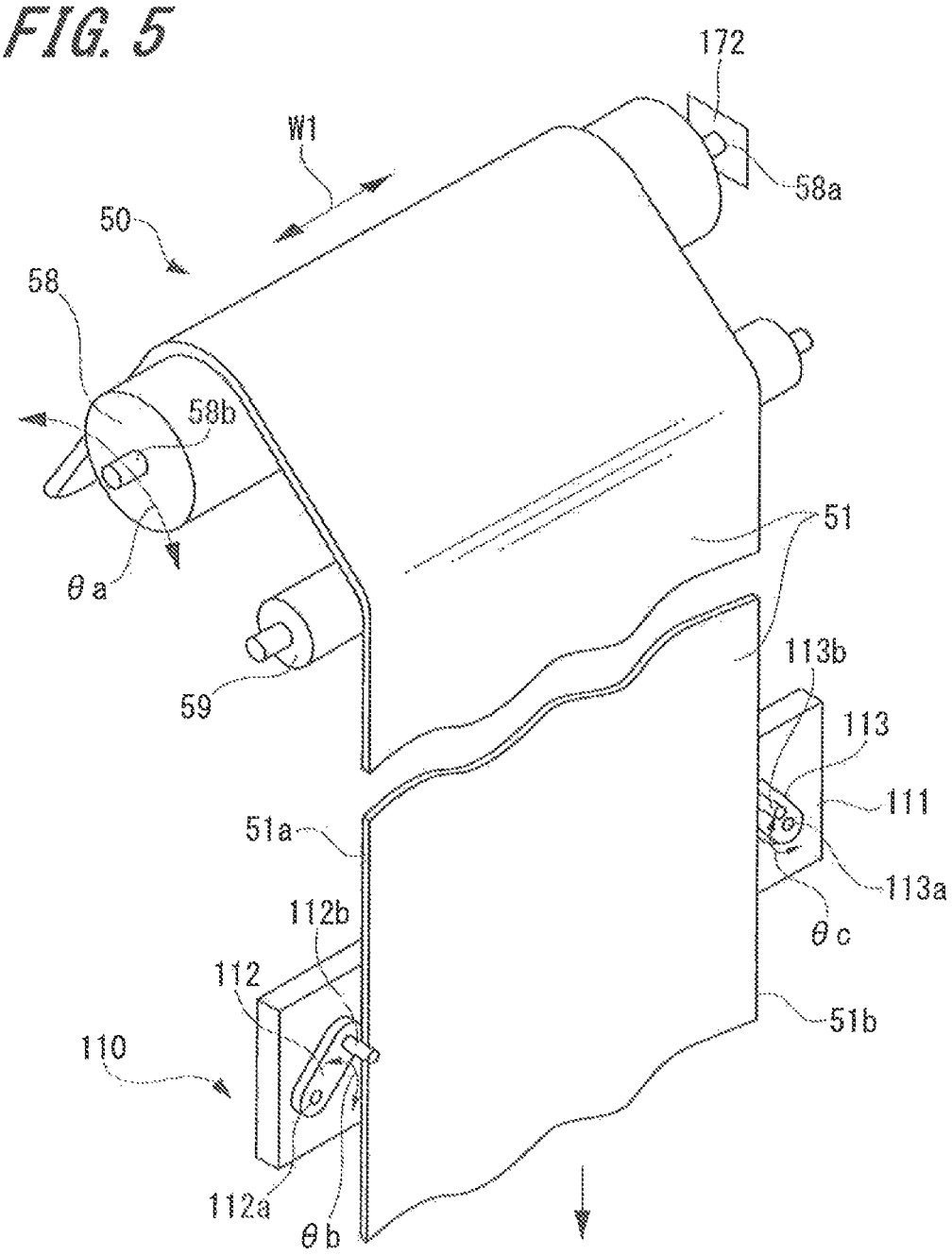
FIG. 5 is a view illustrating a steering roller.

FIG. 5 is an illustration of the steering roller 58.

Figure 6:
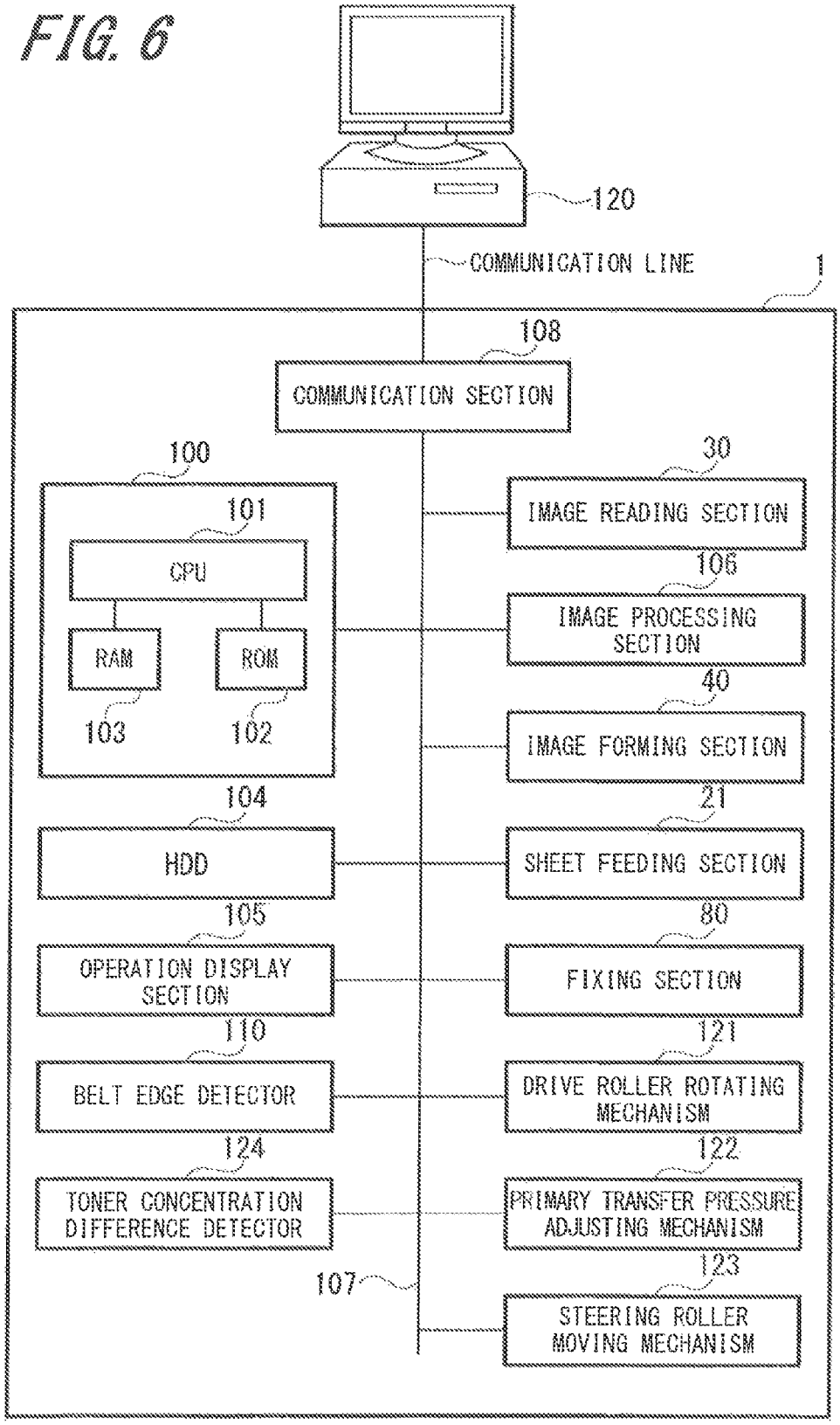
FIG. 6 is a block diagram showing a control system of the image forming apparatus according to the first embodiment of the present invention.

As shown in FIG. 5, one end 58*a* of the steering roller 58 is supported by a roller supporting member 172, and the other end 58*b* of the steering roller 58 is connected to a steering roller moving mechanism 123 (see FIG. 6).

The steering roller moving mechanism 123 displaces the other end 58*b* of the steering roller 58 along a rotational direction θa, just like drawing a circle, with the one end 58*a* of the steering roller 58 as a supporting point. By displacing the other end 58*b*, a steering adjustment is performed to cause the intermediate transfer belt 51 to move in the width direction W1. Hereinafter, the steering adjustment is also referred to as "steering operation".

For example, when the other end 58*b* of the steering roller 58 is displaced toward one side along the rotational direction θa, the intermediate transfer belt 51 will be moved toward the one end 58*a* of the steering roller 58. While when the other end 58*b* of the steering roller 58 is tilted toward the other side along the rotational direction θa, the intermediate transfer belt 51 will be moved toward the other end 58*b* of the steering roller 58.

The steering roller moving mechanism 123 is controlled by the controller 100 (see FIG. 6), which is to be described later. The controller 100 determines the position (i.e., the tilt angle) of the other end 58*b* of the steering roller 58 based on the detection result of a belt edge detector 110, which is to be described later. Further, the controller 100 drive-controls the steering roller moving mechanism 123 to cause the other end 58*b* of the steering roller 58 to be placed at the determined position.

Further, the steering roller 58 also functions as a tension roller for providing a tension to the intermediate transfer belt 51. In the present embodiment, the steering roller 58 is biased upward by a spring member (not shown) so as to provide a tension to the intermediate transfer belt 51. Incidentally, a configuration applied to a normal tension roller can be used as the configuration for providing a tension to the intermediate transfer belt 51.

The belt edge detector 110 is arranged in the vicinity of the intermediate transfer belt 51, and is adapted to detect the position of two edges 51*a*, 51*b* of the intermediate transfer belt 51. The belt edge detector 110 includes a base portion 111 and two levers 112, 113.

The two levers 112, 113 are rotatably attached to the base portion 111 with the intermediate transfer belt 51 sandwiched therebetween in the width direction. The lever 112 faces one edge 51*a* of the intermediate transfer belt 51, and the lever 113 faces the other edge 51*b* of the intermediate transfer belt 51.

The lever 112 has a rotating shaft 112*a* and a contact pin 112*b*. The lever 112 is biased toward the side of the one edge 51*a* of the intermediate transfer belt 51 by a biasing portion such as a spring. With such an arrangement, the contact pin 112*b* of the lever 112 is brought into contact with the one edge 51*a* of the intermediate transfer belt 51.

The lever 113 has a rotating shaft 113*a* and a contact pin 113*b*. The lever 113 is biased toward the side of the other edge 51*b* of the intermediate transfer belt 51 by a biasing portion such as a spring. With such an arrangement, the contact pin 113*b* of the lever 113 is brought into contact with the other edge 51*b* of the intermediate transfer belt 51.

The belt edge detector 110 detects rotation angles θb, θc of the levers 112, 113, and transmits the detection result to the controller 100 (see FIG. 6), which is to be described later. Based on the detection result of the belt edge detector 110, the controller 100 detects the positions of the edges 51*a*, 51*b* of the intermediate transfer belt 51.

Reference values are set in ROM 102 (see FIG. 6), which is to be described later, of the controller 100, wherein the reference values are values of the rotation angles θb, θc when the edges 51*a*, 51*b* of the intermediate transfer belt 51 are located in appropriate positions. If the rotation angles θb, θc change from the reference values, the controller 100 will determine that the edges 51*a*, 51*b* are not located in appropriate positions. Further, the controller 100 converts the change amount of the rotation angles θb, θc from the reference values into change amount of the edges 51*a*, 51*b* to thereby detect the positions of the edges 51*a*, 51*b*.

[Hardware Configuration of Each Section of Image Forming Apparatus]

Next, hardware configuration of each section of the image forming apparatus 1 will be described below with reference to FIG. 6.

FIG. 6 is a block diagram shown a control system of the image forming apparatus 1.

As shown in FIG. 6, the image forming apparatus 1 includes the aforesaid controller 100. The controller 100 is configured on the control board 90 (see FIG. 1), which has been mentioned above.

The controller 100 includes, for example, a CPU (central processing unit) 101, a ROM (read only memory) 102 for storing program(s) executed by the CPU 101 and the like, and a RAM (random access memory) 103 used as work area of the CPU 101. For example, information about the operating amount of the primary transfer pressure adjusting mechanism 122 corresponding to the attitude of the steering roller 58 when performing primary transfer process during the image forming operation (such as a correction table) is stored in the ROM 102. Incidentally, typically an electrically erasable programmable ROM, for example, is used as the ROM 102.

The CPU 101 controls the whole image forming apparatus. The CPU 101 is respectively connected to a HDD (hard disk drive) 104, an operation display section 105 and the belt edge detector 110 through a system bus 107. Further, the CPU 101 is respectively connected to a communication section 108, the image reading section 30, an image processing section 106, the image forming section 40, the sheet feeding section 21, and the fixing section 80 through the system bus 107. Furthermore, the CPU 101 is respectively connected to the drive roller rotating mechanism 121, the primary transfer pressure adjusting mechanism 122, the steering roller moving mechanism 123 and the toner concentration difference detector 124 through a system bus 107.

The HDD 104 is adapted to store the image data of the image of the document read by the image reading section 30, the image data having been outputted, and the like. The operation display section 105 is a touch panel configured by a display such as a liquid crystal display (LCD), an organic ELD (electro luminescent display), or the like. The operation display section 105 is adapted to display an instruction menu for the user, information associated with acquired image data, and the like. Further, the operation display section 105 has a plurality of keys, and is adapted to receive input of data inputted by the user by operating the keys and output an input signal, wherein the data inputted by the user includes various instructions, characters, numbers and the like.

The belt edge detector 110 is adapted to detect the position of the edges 51*a*, 51*b* of the intermediate transfer belt 51, and transmit the detection result to the CPU 101.

The communication section 108 is adapted to receive, through a communication line, job information sent from a PC (personal computer) 120, which is the external device. The received job information is transmitted to the controller 100 through the system bus 107. In the job information, the image data of the image to be formed, the information of the sheet to be used associated with the image data, and the like are set.

Incidentally, although the present embodiment is described based on an example in which a personal computer is used as the external device, the present invention is not limited to such example, but various other devices, such as a facsimile device or the like, can be used as the external device.

The image reading section 30 optically reads the image of the document and converts the image into an electrical signal. For example, when reading a color document, the image reading section 30 generates image data having brightness information of 10 bits per pixel for each RGB. The image data generated by the image reading section 30 or the image data transmitted from the PC 120 (which is an example of the external device connected to the image forming apparatus 1) is sent to the image processing section 106 to be subjected to image processing. The image processing section 106 performs various processing, such as analog processing, A/D conversion, shading correction, image compression and the like, on the received image data.

For example, when color printing is performed by using the image forming apparatus 1, the image data of R, G, B generated by the image reading section 30 and the like is inputted to a color conversion LUT (look-up table) in the image processing section 106. The image processing section 106 color-converts the R, G, B data into Y, M, C, K image data. Further, the image processing section 106 performs various processing on the image data having been subjected to the color-conversion, wherein the various processing includes: correction of tone reproduction characteristic, screen processing of halftone dots with reference to the density correction LUT, edge processing for emphasizing fine lines, and the like.

The image forming section 40 is drive-controlled by the controller 100 to form a toner image on the sheet S. The fixing section 80 is drive-controlled by the controller 100 to press and heat the sheet S, so that the toner image is fixed on the sheet S.

The drive roller rotating mechanism 121 is drive-controlled by the controller 100 to drive the drive roller 55 to rotate, so that intermediate transfer belt 51 is driven to rotate.

The steering roller moving mechanism 123 is drive-controlled by the controller 100 to displace the position (i.e., the angle) of the other end 58*b* of the steering roller 58. The controller 100 performs, in a state where the intermediate transfer belt 51 contacts the photoreceptors 41 (i.e., in the image forming state), steering control to displace the position of the other end 58*b* of the steering roller 58. To be specific, based on the detection result of the belt edge detector 110, the controller 100 sets the tilt angle of the steering roller 58 so that the intermediate transfer belt 51 is placed in appropriate position relative to the photoreceptors 41. Further, the controller 100 causes the position of the other end 58*b* of the steering roller 58 to be displaced so that the steering roller 58 is tilted to the set tilt angle.

The primary transfer pressure adjusting mechanism 122 is a concrete example of the transfer pressure adjusting mechanism of the present invention. The primary transfer pressure adjusting mechanism 122 is drive-controlled by the controller 100 to place the corresponding primary transfer roller 52 to the separated position (i.e., the released state) or the nearby position (i.e., the position where image forming is performed), and adjust the primary transfer pressure when performing image forming for each primary transfer roller 52 based on the attitude of the steering roller 58.

In the image forming state, the positions (i.e., the angles) of the four primary transfer pressure adjusting cams 71 are set according to the attitude (i.e., the adjustment state) of the steering roller 58. Further, the positions (the pressing forces) where the primary transfer rollers 52Y, 52M, 52C, 52K press the inner surface of the intermediate transfer belt 51 are adjusted according to the positions (i.e., the angles) of the four primary transfer pressure adjusting cams 71. With such an arrangement, in the four transfer nips of the intermediate transfer belt 51 corresponding to the four primary transfer rollers 52Y, 52M, 52C, 52K, the primary transfer pressure is adjusted according to the tilt angle of the steering roller 58, so that the primary transfer pressure becomes uniform in the width direction of the intermediate transfer belt 51.

In the toner concentration difference detector 124, the toner detectors 91*a*, 91*b* respectively detect the toner concentration of the toner image transferred from the photoreceptors 41 of the four image forming units to the intermediate transfer belt 51, and output the detection result to the controller 100. Based on the detection result outputted from the toner detector 91*a*, 91*b*, the CPU 101 of the controller 100 calculates the toner concentration difference in the width direction of the intermediate transfer belt 51, and stores the calculation result in the RAM 103, ROM 102, or the HDD 104.

[Correction Table Creating Process]

Next, an example of correction table creating process will be described below, wherein the correction table is adapted to be referred to when performing primary transfer process during the image forming operation.

Figure 7:
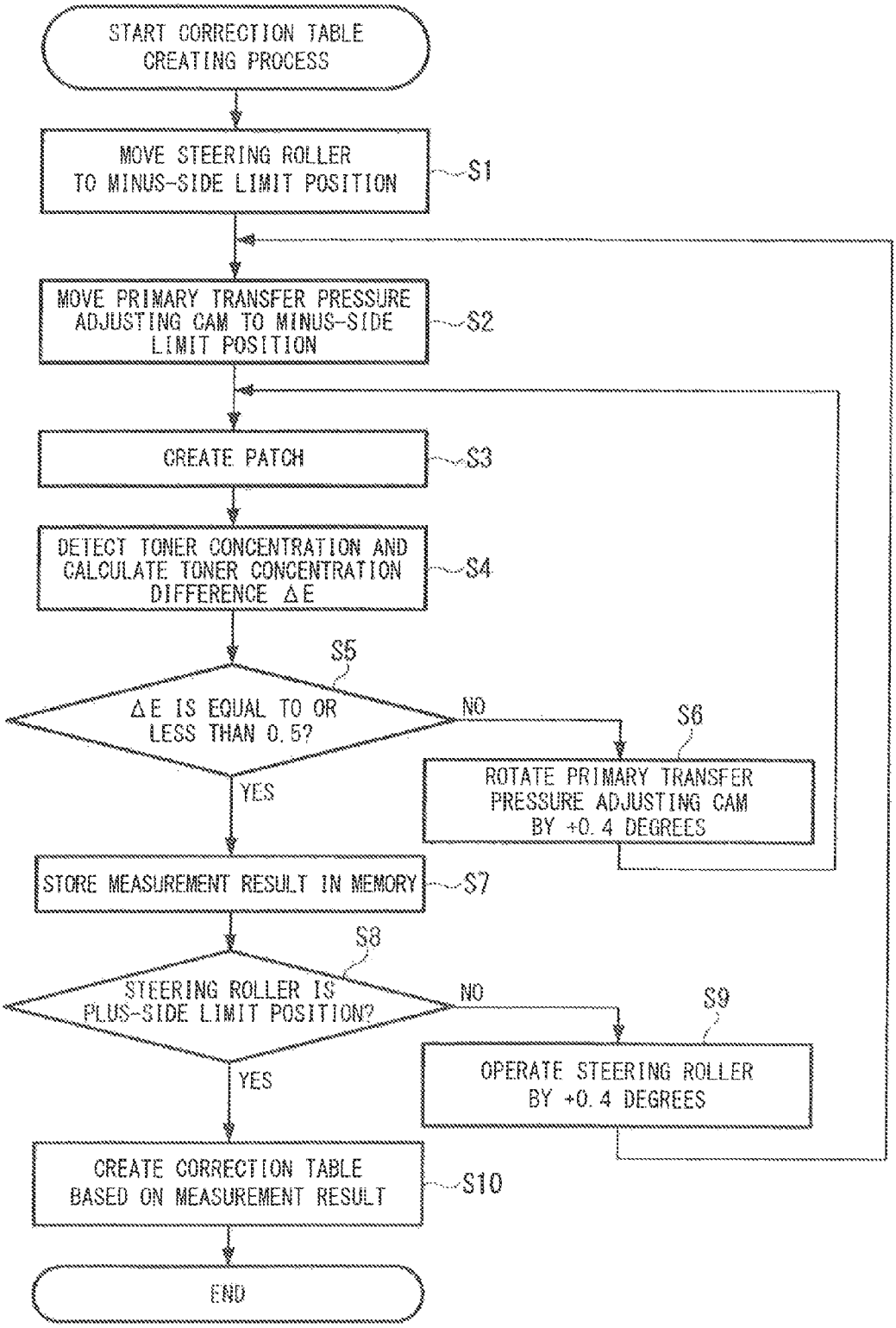
FIG. 7 is a flowchart showing an example of a process for creating a correction table to be referred to when the image forming apparatus according to the first embodiment of the present invention performs primary transfer.

FIG. 7 is a flowchart showing an example of the correction table creating process.

First, the CPU 101 of the controller 100 determines whether or not the image forming apparatus 1 is set into a correction table creating mode. The correction table creating mode is set at time such as: when the image forming apparatus 1 is being produced; before the image forming apparatus 1 is shipped; when the image forming apparatus 1 is installed in a destination site; and before the image forming apparatus 1 has been used to perform a job. If the CPU 101 has determined that the image forming apparatus 1 is set into the correction table creating mode, the correction table creating process will be started.

First, the CPU 101 drive-controls the steering roller moving mechanism 123 to move the steering roller 58 toward the minus-side limit position (step S1). Next, in the state where the steering roller 58 is fixed to the minus-side limit position, the CPU 101 drive-controls the primary transfer pressure adjusting mechanism 122 to move the primary transfer pressure adjusting cam 71 of the primary transfer pressure adjuster 70 corresponding to the primary transfer roller 52Y toward the minus-side limit position (step S2).

Next, the CPU 101 controls the first image forming unit 40Y to create a patch (which is a toner image used for detecting toner concentration different), and form the created patch on the photoreceptor 41 (step S3). The patch formed on the photoreceptor 41 is transferred to the intermediate transfer belt 51 by the primary transfer roller 52Y.

The patch used in the present embodiment is not particularly limited as long as it can be used to detect the toner concentration difference in the width direction of the intermediate transfer belt 51. For example, a so-called solid image having toner formed on whole area thereof, an image having toner continuously formed in the width direction corresponding to the toner detectors 91*a*, 91*b*, or an image having toner formed only in portions corresponding to the toner detectors 91*a*, 91*b* can be used as the patch. Incidentally, among the aforesaid three types of images, the second type image uses less toner and consumes less patch-creating time than the first type image, and the third type image uses further less toner and consumes further less patch-creating time.

The toner detectors 91*a*, 91*b* of the toner concentration difference detector 124 detects the toner concentration of the patch transferred to the intermediate transfer belt 51 and conveyed thereto, and outputs the detection result to the CPU 101. Based on the detection result of the toner concentration supplied by the toner detectors 91*a*, 91*b*, the CPU 101 calculates the toner concentration difference ΔE between the proximal side and the distal side of the intermediate transfer belt 51 (i.e., the toner concentration difference ΔE in the width direction of the intermediate transfer belt 51) (step S4).

Next, the CPU 101 determines whether or not the calculated toner concentration difference ΔE is equal to or less than 0.5 (step S5). Generally, ΔE is an index showing different between two colors as an absolute value, and in the present embodiment, ΔE is used as an indicator that indicates the toner concentration difference. The larger the value of ΔE is, the greater the toner concentration difference becomes; and in the present embodiment, 0.5 is set as a threshold for determining whether there is toner concentration difference. Note that 0.5 is merely an example of the threshold, and the present invention is not limited to such example.

If ΔE is larger than 0.5, the CPU 101 will drive-control the primary transfer pressure adjusting mechanism 122 to rotate the primary transfer pressure adjusting cam 71 by, for example, +0.4 degree (step S6). Next, the CPU 101 returns to step S3 to create the patch again. Further, in steps S4 and S5, the CPU 101 detects the toner concentration and calculates the toner concentration difference ΔE, and determines again whether or not the calculated toner concentration difference ΔE is equal to or less than 0.5.

If it is determined in step S5 that ΔE is equal to or less than 0.5, the CPU 101 will store the attitude (i.e., the tilt angle) of the steering roller 58 and the position (i.e., the angle) of the primary transfer pressure adjusting cam 71 at that time in a memory such as the RAM 103 or the like (step S7).

Next, the CPU 101 determines whether or not the position of the steering roller 58 is the plus-side limit position (step S8). If the position of the steering roller 58 is not the plus-side limit position, the CPU 101 will drive-control the steering roller moving mechanism 123 to move the steering roller 58 by, for example, +0.4 degree from the current position (step S9). Next, the CPU 101 returns to step S2 to move the primary transfer pressure adjusting cam 71 toward the minus-side limit position. Further, the CPU 101 performs processes of steps S3 to S9, which are: creating the patch, detecting the toner concentration, calculating the toner concentration difference ΔE, determining ΔE, and performing process according to the result of the determination.

If it is determined in step S8 that the position of the steering roller 58 is the plus-side limit position, the CPU 101 will create, based on the measurement result stored in the RAM 103, the correction table to be used to adjust the primary transfer pressure of the primary transfer roller 52Y (step S10). The created correction table is stored in a non-volatile storage medium such as the ROM 102, the HDD 104 or the like.

The CPU 101 does the same with each of the primary transfer rollers 52M, 52C, 52K, i.e., the CPU 101 causes the attitude of the steering roller 58 to change, and causes the toner concentration difference detector 124 to measure the toner concentration difference ΔE after transfer for each different attitude of the steering roller 58. The CPU 101 acquires the operating amount of the primary transfer pressure adjusting mechanism 122 (i.e., the position (angle) of the primary transfer pressure adjusting cam 71) for each of the four primary transfer rollers 52Y, 52M, 52C, 52K in the case where the toner concentration difference ΔE is equal to or less than the threshold, and creates the correction table. In such a manner, the correction table 125 to be used for performing the primary transfer pressure adjustment of the four primary transfer rollers 52Y, 52M, 52C, 52K is finally completed.

Thus, the correction table for being used to adjust the primary transfer pressure of each primary transfer roller 52 can be created later, instead of being prepared from the beginning. Further, by possessing parameters associated with the primary transfer pressure adjustment as the correction table, data amount can be reduced.

Incidentally, an example in which the steering roller 58 is caused to move from the minus-side limit position toward the plus-side limit position to create the correction table has been described with reference to FIG. 7; by causing the steering roller 58 to move along one direction from the minus-side toward the plus-side, the time necessary for creating the correction table can be reduced. However, instead of being limited to this example, the present invention also includes other examples, such as an example in which the steering roller 58 is moved at a tilt angle from 0 degree toward the plus-side to adjust the primary transfer pressure adjusting cam 71, and then the steering roller 58 is moved at tilt angle from 0 degree toward the minus-side to adjust the primary transfer pressure adjusting cam 71.

The creation of the correction table is described based on an example in which the steering roller 58 is caused to move from the minus-side limit position toward the plus-side limit position to set the rotation angle of the primary transfer pressure adjusting cam 71. The minus-side limit position is −2 degrees, for example; and the plus-side limit position is +2 degrees, for example. The rotation angle of the primary transfer pressure adjusting cam 71 may also be set in a predetermined range between the minus-side limit position and the plus-side limit position. For example, if the minus-side limit position is −2 degrees and the plus-side limit position is +2 degrees, the rotation angle of the primary transfer pressure adjusting cam 71 may also be set in a predetermined range between −2 degrees and +2 degrees.

FIG. 8 shows a correction table 125, which is an example of the correction table to be referred to when the image forming apparatus 1 performs the primary transfer.

The correction table 125 of FIG. 8 shows positions (angles) of the four primary transfer pressure adjusting cams 71 in the case where the attitude (the tilt angle) of the steering roller 58 is moved between −2 degrees and +2 degrees. When the tilt angle of the steering roller 58 is 0 degree, the angles of the four primary transfer pressure adjusting cams 71 corresponding to the primary transfer rollers 52Y, 52M, 52C, 52K are each 0 degree. In the correction table 125, the value of the cam angle of each of the four primary transfer pressure adjusting cams 71 is symmetric between plus-side and the minus-side with 0 degree of the tilt angle of the steering roller 58 as the center; however, the present invention is not limited to such example. For example, when the tilt angle of the steering roller 58 is 0 degree, the angles of the four primary transfer pressure adjusting cams 71 do not have to be 0 degree; further, the value of the cam angle may also be asymmetric between plus-side and the minus-side depending on the correction table creating process or a correction table modifying process, which is to be described later.

Further, in the correction table 125, when the attitude (i.e., the tilt angle) of the steering roller 58 is the plus-side, among the four primary transfer pressure adjusting cams 71, the primary transfer pressure adjusting cam 71 on more upstream side in the rotational direction of the intermediate transfer belt has larger angle value. In contrast, when the attitude (i.e., the tilt angle) of the steering roller 58 is the minus-side, among the four primary transfer pressure adjusting cams 71, the primary transfer pressure adjusting cam 71 on more upstream side in the rotational direction of the intermediate transfer belt has smaller angle value.

It can be known from the content of the correction table 125 that the center of the distortion of the primary transfer pressure of the intermediate transfer belt 51 is in the vicinity of the primary transfer roller 52C; and it can also be known from the content of the correction table 125 that with the change of the attitude of the steering roller 58, the more the upstream side the primary transfer roller 52 is located on in the rotational direction of the intermediate transfer belt 51, the larger the non-uniform of the primary transfer pressure becomes. In other words, by changing the angle of the four primary transfer pressure adjusting cams 71 based on the correction table 125, the aforesaid non-uniform of the primary transfer pressure of the intermediate transfer belt 51 can be eliminated.

[Primary Transfer Pressure Adjusting Process]

Next, a primary transfer pressure adjusting process using the correction table will be described below. Described below is a case where the intermediate transfer belt 51 is set from the released state to the image forming state to adjust the primary transfer pressure in the image forming state.

First, the CPU 101 of the controller 100 controls the driving of the drive roller rotating mechanism 121 to drive the released intermediate transfer belt 51 to rotate, and drive-controls a photoreceptor rotating mechanism (not shown) to drive the four photoreceptors 41 to rotate. When the rotation speed of both the intermediate transfer belt 51 and the four photoreceptors 41 reaches a predetermined speed, the CPU 101 will drive-control the four primary transfer pressure adjusting mechanisms 122 to cause each of the four primary transfer rollers 52Y, 52M, 52C, 52K to move to the nearby position, which is the position where the four primary transfer rollers 52Y, 52M, 52C, 52K respectively come close to the four photoreceptors 41 (see FIGS. 2 and 3).

Thus, the primary transfer rollers 52Y, 52M, 52C, 52K press the inner surface of the intermediate transfer belt 51. As a result, the primary transfer rollers 52Y, 52M, 52C, 52K are pressed toward the four photoreceptors 41, so that the intermediate transfer belt 51 comes into contact with the four photoreceptors 41.

At this time, the CPU 101 sets the tilt angle of the steering roller 58 based on the detection result of the belt edge detector 110. Further, the CPU 101 drive-controls the steering roller moving mechanism 123 to displace the other end 58*b* of the steering roller 58 so that the angle of the steering roller 58 becomes a preset tilt angle (steering control).

The CPU 101 refers to the correction table stored in the ROM 102 to read out the angle of the primary transfer pressure adjusting cam 71 corresponding to the tilt angle of the steering roller 58 for each of the primary transfer rollers 52Y, 52M, 52C, 52K. Based on the read out angle of the primary transfer pressure adjusting cam 71 of each of the primary transfer rollers 52Y, 52M, 52C, 52K, the CPU 101 causes the drive section (not shown) to drive the four primary transfer pressure adjusting cams 71 to rotate. Thus, the primary transfer rollers 52Y, 52M, 52C, 52K press the inner surface of the intermediate transfer belt 51 based on the angles of the respective primary transfer pressure adjusting cams 71 thereof, so that the primary transfer pressure in the width direction of the intermediate transfer belt 51 is adjusted.

Figure 9:
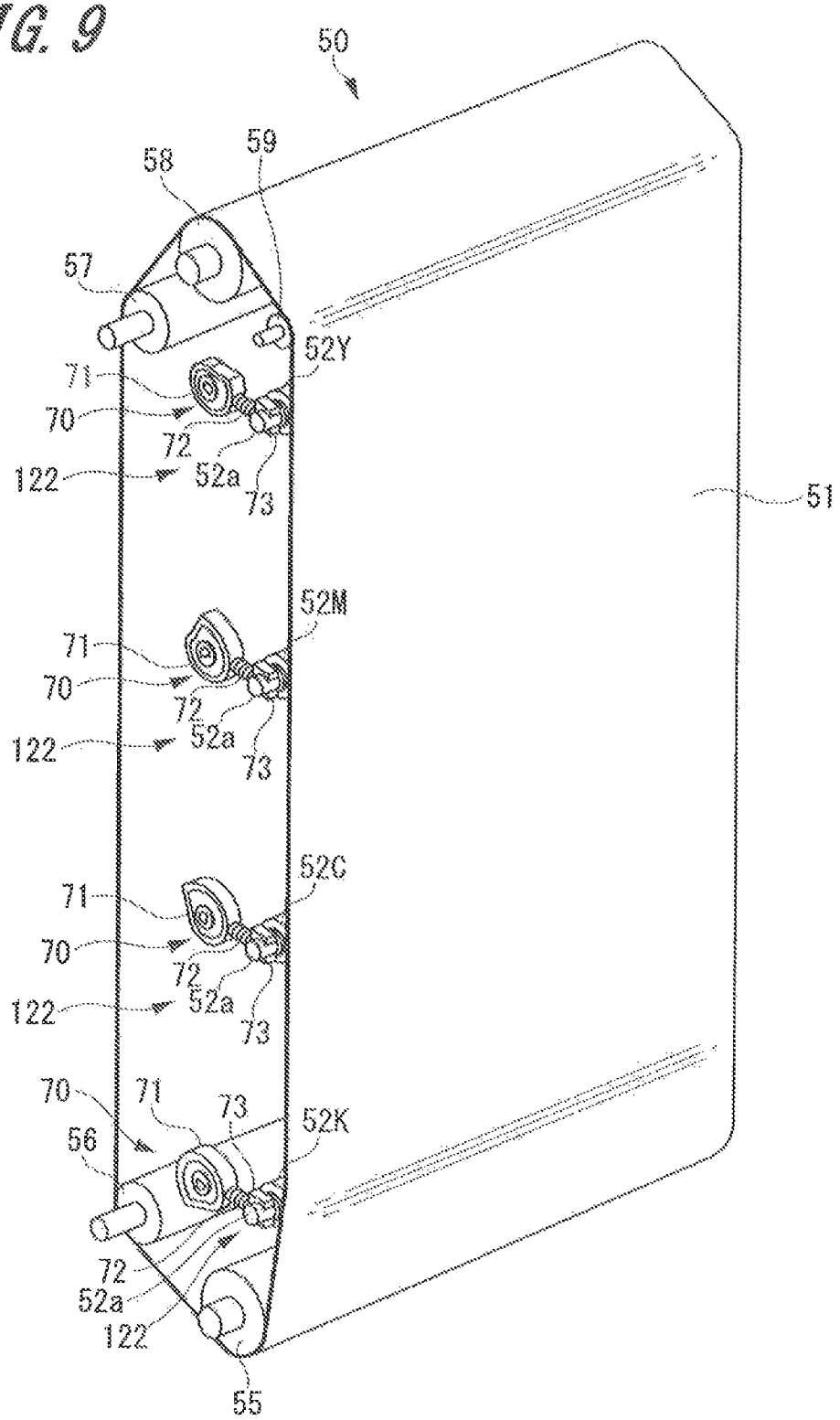
FIG. 9 is a schematic perspective view for explaining an example of the operation of the primary transfer pressure adjuster corresponding to the primary transfer roller (yellow (Y)), the operation of a primary transfer pressure adjuster corresponding to a primary transfer roller (magenta (M)), the operation of a primary transfer pressure adjuster corresponding to a primary transfer roller (cyan (C)), and the operation of a primary transfer pressure adjuster corresponding to a primary transfer roller (black (K)), based on the correction table according to the first embodiment of the present invention.

FIG. 9 is a schematic perspective view for explaining an example of the operation of the four primary transfer pressure adjusters 70 based on the correction table 125. The example given in FIG. 9 shows a state where the tilt angle of the steering roller 58 of the correction table 125 is 2 degrees.

Figure 10:
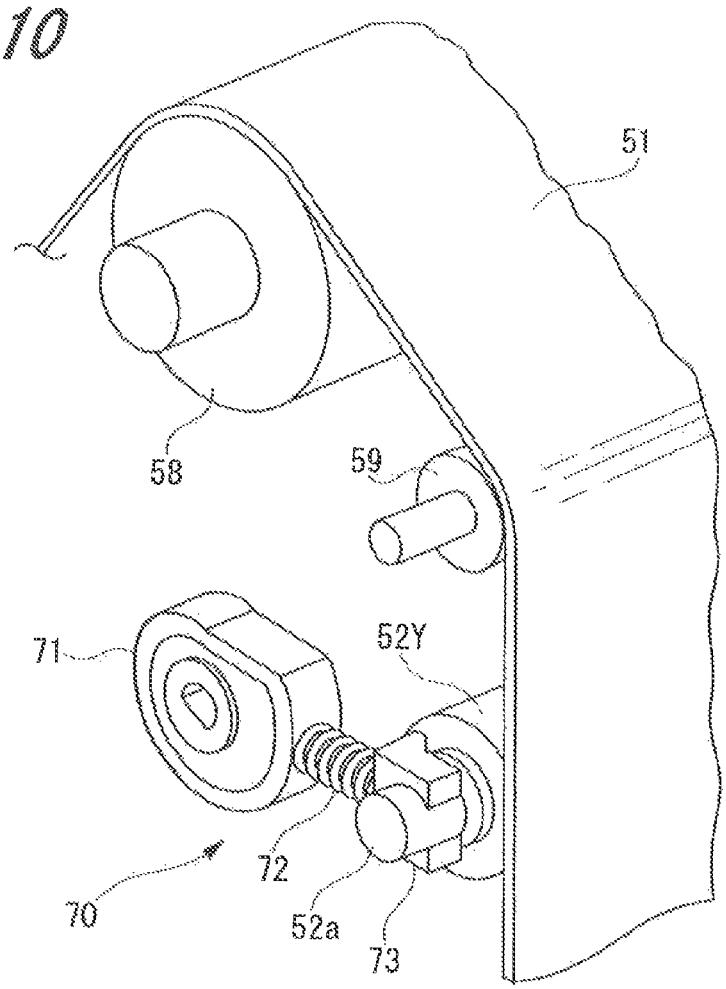
FIG. 10 is an enlarged perspective view of the primary transfer pressure adjuster corresponding to the primary transfer roller (yellow (Y)) shown in FIG. 9.

FIG. 10 is an enlarged perspective view of the primary transfer pressure adjuster 70 corresponding to the primary transfer roller 52Y shown in FIG. 9. Based on the correction table 125, the angle of the primary transfer pressure adjusting cam 71 is controlled to 120 degrees. At this time, since the stroke of the biasing member 72 is large, the force with which the primary transfer roller 52Y presses the proximal-side portion of the intermediate transfer belt 51 is strong.

Figure 11:
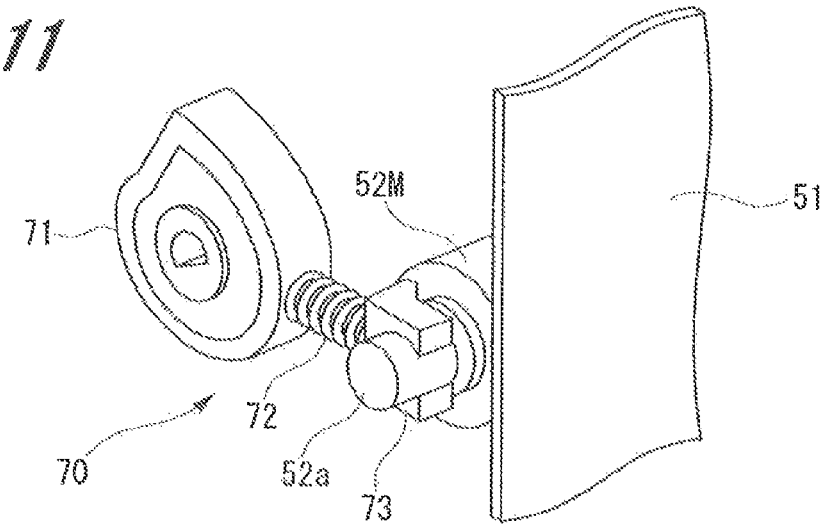
FIG. 11 is an enlarged perspective view of the primary transfer pressure adjuster corresponding to the primary transfer roller (magenta (M)) shown in FIG. 9.

FIG. 11 is an enlarged perspective view of the primary transfer pressure adjuster 70 corresponding to the primary transfer roller 52M shown in FIG. 9. Based on the correction table 125, the angle of the primary transfer pressure adjusting cam 71 is controlled to 72 degrees. At this time, since the stroke of the biasing member 72 is slightly larger than normal time (for example, the time when the rotating shaft of the primary transfer roller is located at reference position O), the force with which the primary transfer roller 52M presses the proximal-side portion of the intermediate transfer belt 51 is weaker than the case of the primary transfer roller 52Y.

Figure 12:
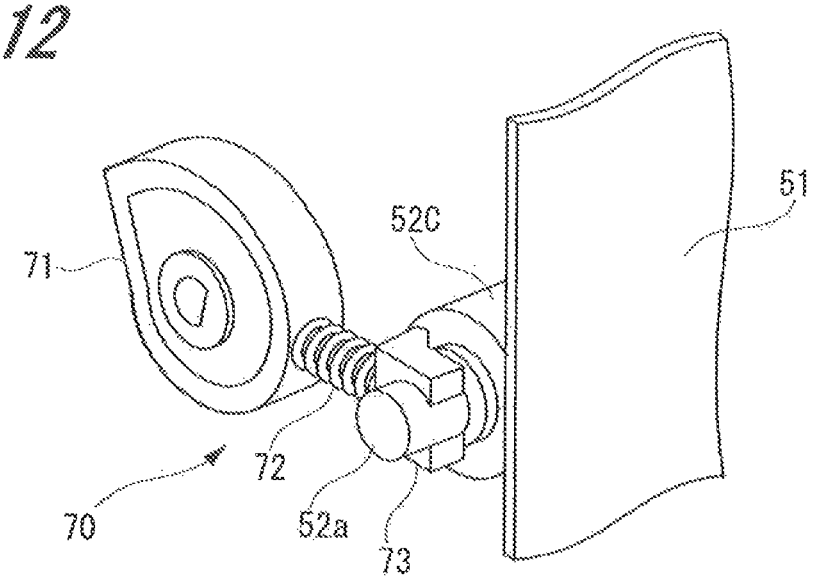
FIG. 12 is an enlarged perspective view of the primary transfer pressure adjuster corresponding to the primary transfer roller (cyan (C)) shown in FIG. 9.

FIG. 12 is an enlarged perspective view of the primary transfer pressure adjuster 70 corresponding to the primary transfer roller 52C shown in FIG. 9. Based on the correction table 125, the angle of the primary transfer pressure adjusting cam 71 is controlled to 15 degrees. At this time, since the stroke of the biasing member 72 is slightly smaller than normal time (for example, the time when the rotating shaft of the primary transfer roller is located at reference position O), the force with which the primary transfer roller 52C presses the proximal-side portion of the intermediate transfer belt 51 is weaker than the case of the primary transfer roller 52M.

Figure 13:
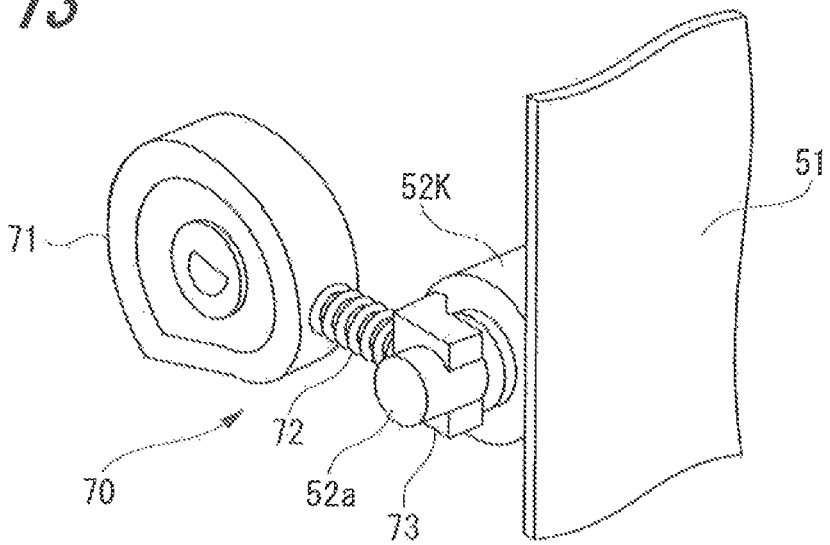
FIG. 13 is an enlarged perspective view of the primary transfer pressure adjuster corresponding to the primary transfer roller (black (K)) shown in FIG. 9.

FIG. 13 is an enlarged perspective view of the primary transfer pressure adjuster 70 corresponding to the primary transfer roller 52K shown in FIG. 9. Based on the correction table 125, the angle of the primary transfer pressure adjusting cam 71 is controlled to −72 degrees. At this time, since the stroke of the biasing member 72 is small, the force with which the primary transfer roller 52K presses the proximal-side portion of the intermediate transfer belt 51 is weaker than the case of the primary transfer roller 52C.

Thus, according to the present embodiment, the operating amount of each primary transfer pressure adjusting mechanism 122 is controlled corresponding to the attitude of the steering roller 58 based on the correction table 125, so that the primary transfer pressure is maintained uniform in the width direction of the intermediate transfer belt 51. With such a configuration, the toner concentration difference of the toner image primarily-transferred to the intermediate transfer belt 51 in the width direction of the intermediate transfer belt 51 can be maintained below a threshold, so that the quality of the toner image after primary transfer can be improved. Incidentally, with such a configuration, when performing primary transfer, it is possible to mechanically adjust the primary transfer pressure without performing electrical fine adjustment or major adjustment.

Further, it is possible to independently control the primary transfer pressure adjuster 70 (the primary transfer pressure adjusting cam 71) of the primary transfer pressure adjusting mechanism 122 for each of the primary transfer rollers 52Y, 52M, 52C, 52K. Thus, it is possible to adjust the primary transfer pressure for each of the primary transfer rollers 52Y, 52M, 52C, 52K, and therefore it is possible to perform fine image quality adjustment for each color of toner.

The controller 100 controls the driving of the drive-control of the primary transfer pressure adjusting mechanism 122 (i.e., the driving of the drive-control of the primary transfer pressure adjusting cam 71) for performing primary transfer at time when the primary transfer operation during the image forming processing is not being performed. Examples of the time when the primary transfer operation during the image forming processing is not being performed includes a period between a primary transfer operation for a precedent sheet and a primary transfer operation for a subsequent sheet. Thus, it is possible to drive-control the primary transfer pressure adjusting cams 71 to maintain the primary transfer pressure uniform in the width direction of the intermediate transfer belt 51 without changing the time necessary for performing image forming processing.

Incidentally, although a plurality of tilt angles of the steering roller are registered in the correction table, there is a possibility that the actual tilt angle of the steering roller falls between two adjacent values registered in the correction table. In such a case, for example, an interpolation process adjacent may be performed between two adjacent values of the rotation angles of the primary transfer pressure adjusting cam with respect to two adjacent tilt angles of the steering roller in the correction table, to thereby determine the rotation angle of the primary transfer pressure adjusting cam to be operated.

[Operating Curve of Primary Transfer Pressure Adjusting Cam]

Incidentally, the present embodiment is described based on an example in which the driving of the primary transfer pressure adjusting cam 71 when performing primary transfer is controlled according to the correction table; however, the driving of the primary transfer pressure adjusting cam may also be controlled according to an operating curve of the primary transfer pressure adjusting cam 71.

Figure 14:
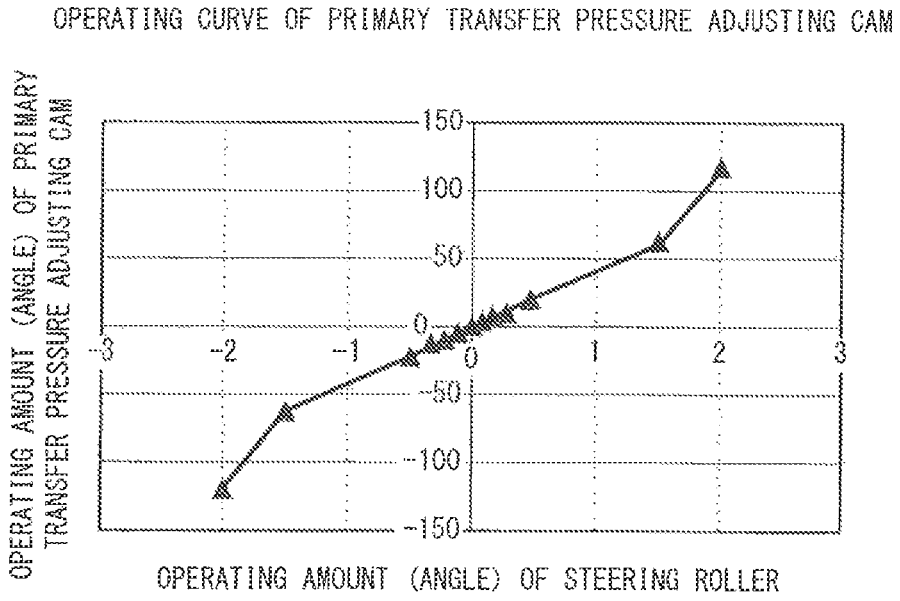
FIG. 14 is a graph showing an example of an operating curve of a primary transfer pressure adjusting cam of the image forming apparatus according to the first embodiment of the present invention.

FIG. 14 is a graph showing an example of the operating curve of one primary transfer pressure adjusting cam 71 of the image forming apparatus 1.

The graph shown in FIG. 14 is an example of the operating curve of the primary transfer pressure adjusting cam 71 corresponding to the primary transfer roller 52Y. In the graph shown in FIG. 14, the horizontal axis represents the operating amount (the tilt angle) of the steering roller 58, and the vertical axis represents the operating amount (the rotation angle) of the primary transfer pressure adjusting cam 71. The operating curve can be created by using, for example, the measurement result obtained when creating the correction table 125 shown in FIG. 8. For example, the operating curve can be created by properly using various methods such as: connecting adjacent measured points with straight lines; performing interpolation between adjacent measured points; obtaining optimal regression line using a least-square method, and the like.

The created operating curve of the primary transfer pressure adjusting cam 71 is stored in a non-volatile storage medium such as the ROM 102. When performing primary transfer, the controller 100 determines the rotation angle of the primary transfer pressure adjusting cam 71 corresponding to the attitude (the tilt angle) of the steering roller 58 based on the operating curve of the primary transfer pressure adjusting cam 71, and causes the primary transfer pressure adjusting cam 71 to operate according to the value of the rotation angle.

With such a configuration, for example, when the image forming apparatus 1 operates the steering roller 58 more finely stepped than the values of tilt angles registered in the correction table, the primary transfer pressure adjusting cam 71 can be adjusted to a suitable position based on the operating curve of the primary transfer pressure adjusting cam 71.

[Modification of Correction Table]

In the aforesaid method of creating the correction table (see FIG. 8), the following steps have been repeatedly performed: fixing the steering roller 58 in a particular attitude (tilt angle), creating a patch, adjusting the primary transfer pressure, creating a patch . . . . Here, based on the data measured when creating the correction table, a toner concentration gradient correction curve is created which shows the relationship between the operating amount (the rotation angle) of the primary transfer pressure adjusting cam 71 and the toner concentration difference ΔE (the toner concentration gradient). Further, based on the toner concentration gradient correction curve, the correction table or the primary transfer pressure adjusting cam operating curve (see FIG. 14) is modified.

Figure 15:
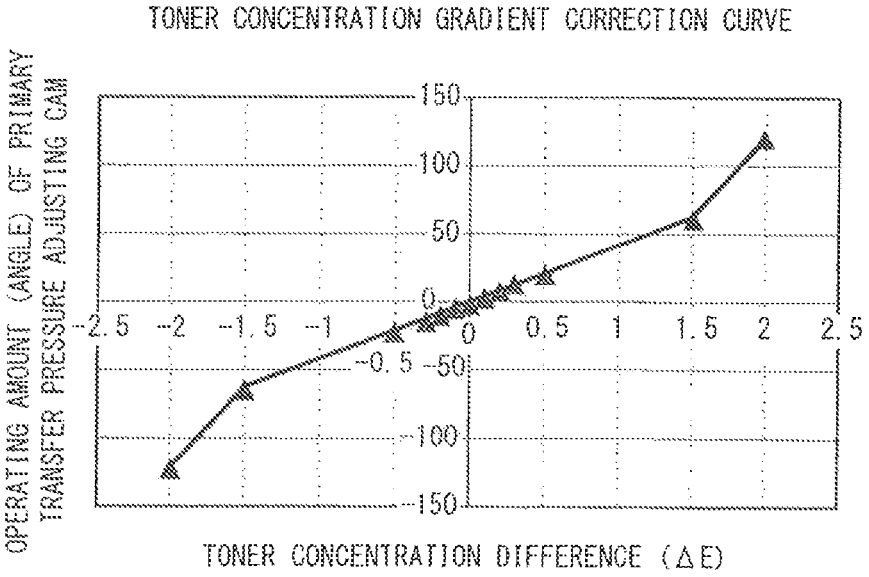
FIG. 15 is a graph showing an example of a toner concentration gradient correction curve of the image forming apparatus according to the first embodiment of the present invention.

In the graph shown in FIG. 15, the horizontal axis represents the toner concentration difference ΔE (the toner concentration gradient), and the vertical axis represents the operating amount (the rotation angle) of the primary transfer pressure adjusting cam 71.

In the graph shown in FIG. 15, the horizontal axis represents the operating amount (the rotation angle) of the primary transfer pressure adjusting cam 71, and the vertical axis represents the toner concentration difference ΔE (the toner concentration gradient). The change of the toner concentration difference ΔE corresponding to the operating amount of the primary transfer pressure adjusting cam 71 can be known from the graph. In other words, the operating amount of the primary transfer pressure adjusting cam 71 to be modified can be obtained even if the toner concentration difference ΔE is changed for some reason.

Figure 16:
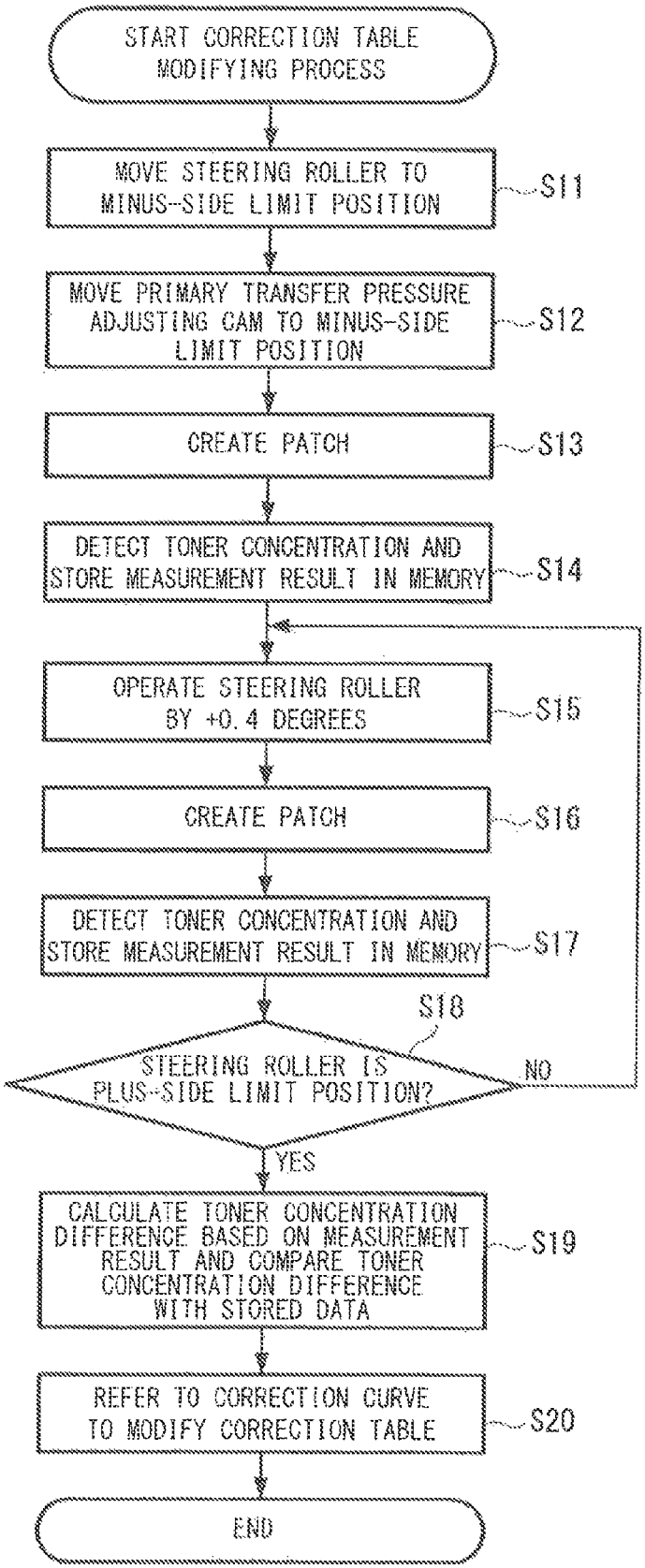
FIG. 16 is a flowchart showing an example of a process for modifying a correction table to be referred to when the image forming apparatus according to the first embodiment of the present invention performs primary transfer.

FIG. 16 is a flowchart showing an example of a process for modifying a correction table to be referred to when the image forming apparatus 1 performs primary transfer.

First, the CPU 101 of the controller 100 determines whether or not the image forming apparatus 1 is set into a correction table modifying mode. The correction table modifying mode is set at time such as: after the image forming apparatus 1 has received a job, immediately after the image forming apparatus 1 has started to perform a job, or the like. If the CPU 101 has determined that the image forming apparatus 1 is set into the correction table modifying mode, the correction table modifying process will be started.

First, the CPU 101 drive-controls, based on the correction table, the steering roller moving mechanism 123 to move the steering roller 58 toward the minus-side limit position, for example (step S11). Next, in the state where the steering roller 58 is fixed to the minus-side limit position, the CPU 101 drive-controls the primary transfer pressure adjusting mechanism 122 to move the primary transfer pressure adjusting cam 71 of the primary transfer pressure adjuster 70 corresponding to the primary transfer roller 52Y toward the minus-side limit position (step S12). In other words, the CPU 101 moves the steering roller 58 and the primary transfer pressure adjusting cam 71 respectively to the attitude (the tilt angle) of the steering roller 58 and the position (the angle) of the primary transfer pressure adjusting cam 71 registered in the correction table.

Next, the CPU 101 controls the first image forming unit 40Y to create a patch used for detecting toner concentration difference, and form the created patch on the photoreceptor 41 (step S13). The patch formed on the photoreceptor 41 is transferred to the intermediate transfer belt 51 by the primary transfer roller 52Y.

The toner detectors 91*a*, 91*b* of the toner concentration difference detector 124 detects the toner concentration of the patch transferred to the intermediate transfer belt 51 and conveyed thereto, and outputs the detection result to the CPU 101. The CPU 101 stores the toner concentration in the attitude (i.e., the tilt angle) of the steering roller 58 and the position (i.e., the angle) of the primary transfer pressure adjusting cam 71 at that time in a memory such as the RAM 103 or the like (step S14).

Next, the CPU 101 drive-controls the steering roller moving mechanism 123 to move the steering roller 58 by +0.4 degree from the current position (step S15).

Next, the CPU 101 controls the first image forming unit 40Y to create a patch, and form the created patch on the photoreceptor 41 (step S16).

The CPU 101 acquires the detection result of the toner concentration of the patch from the toner detector 91*a*, 91*b* of the toner concentration difference detector 124. Further, the CPU 101 stores the toner concentration in the attitude (i.e., the tilt angle) of the steering roller 58 and the position (i.e., the angle) of the primary transfer pressure adjusting cam 71 at that time in a memory such as the RAM 103 or the like (step S14).

Next, the CPU 101 determines whether or not the position of the steering roller 58 is the plus-side limit position (step S18). If the position of the steering roller 58 is not the plus-side limit position, the process will be brought ahead to step S15 where the CPU 101 drive-controls the steering roller moving mechanism 123 to move the steering roller 58 by +0.4 degree from the current position.

Next, the CPU 101 performs processes of steps S3 to S9, which are: creating the patch, detecting the toner concentration, determining the position of the steering roller 58, and performing process according to the result of the determination.

If it is determined in the determination process of step S18 that the position of the steering roller 58 is the plus-side limit position, the CPU 101 will calculate, based on the measurement result stored in the RAM 103, the toner concentration difference ΔE between the proximal side and the distal side of the intermediate transfer belt 51 for each position of the steering roller 58. Further, the calculated toner concentration difference ΔE is compared with the toner concentration difference ΔE obtained when creating the correction table stored in the memory (step S19).

Based on the comparison result of the toner concentration difference ΔE, the CPU 101 refers to the toner concentration gradient correction curve (see FIG. 15) to modify the correction table of the primary transfer roller 52Y stored in the non-volatile storage medium (step S20). The operating amount (the angle) of the primary transfer pressure adjusting cam 71 to be amended with respect to the variation (the difference) of the toner concentration difference ΔE can be known from the toner concentration gradient correction curve. The CPU 101 obtains the difference of the toner concentration difference ΔE for each position of the steering roller 58. Further, the CPU 101 acquires the operating amount (the angle) of the primary transfer pressure adjusting cam 71 to be amended corresponding to the difference of the toner concentration difference ΔE, and modifies the angle of the primary transfer pressure adjusting cam 71 in the correction table.

The CPU 101 does the same with each of the primary transfer rollers 52M, 52C, 52K, i.e., the CPU 101 causes the attitude of the steering roller 58 to change, and causes the toner concentration difference detector 124 to measure the toner concentration difference ΔE of the patch for each different attitude of the steering roller 58). Further, the CPU 101 modifies the correction table for each of the four primary transfer rollers 52Y, 52M, 52C, 52K.

By modifying the correction table in such a manner, it is possible to modify the correction table quickly at time such as: after receiving a job, immediately after starting a job, and the like. Further, it is possible to adjust the angle of the primary transfer pressure adjusting cam 71 for each different attitude of the steering roller 58, according to the change amount of the toner concentration difference ΔE after the correction table has been created. By suitably modifying the correction table, the primary transfer pressure can be constantly maintained uniform in the width direction of the intermediate transfer belt 51.

Described above is an example in which the correction table is modified; however, the primary transfer pressure adjusting cam operating curve shown in FIG. 14 may also be modified in the same manner.

[Modification of First Embodiment]

The first embodiment is described based on a configuration in which the primary transfer pressure adjusting mechanism 122 includes a roller supporting member 171 that rotatably supports the primary transfer roller 52Y, a moving unit (not shown) adapted to move the roller supporting member 171, and a primary transfer pressure adjuster 70. However, the present invention also includes a configuration in which the change of the radius of the primary transfer pressure adjusting cam 71 with its rotation is increased, and the moving unit for moving the roller supporting member 171 is eliminated from the primary transfer pressure adjusting mechanism 122. Thus, the intermediate transfer belt 51 is moved toward the separated position or the nearby position only by the change of the radius of the primary transfer pressure adjusting cam 71 with its rotation, and the primary transfer pressure is adjusted in the nearby position. With such a configuration, the configuration of the primary transfer pressure adjusting mechanism 122 can be simplified.

2. Second Embodiment

Figure 17:
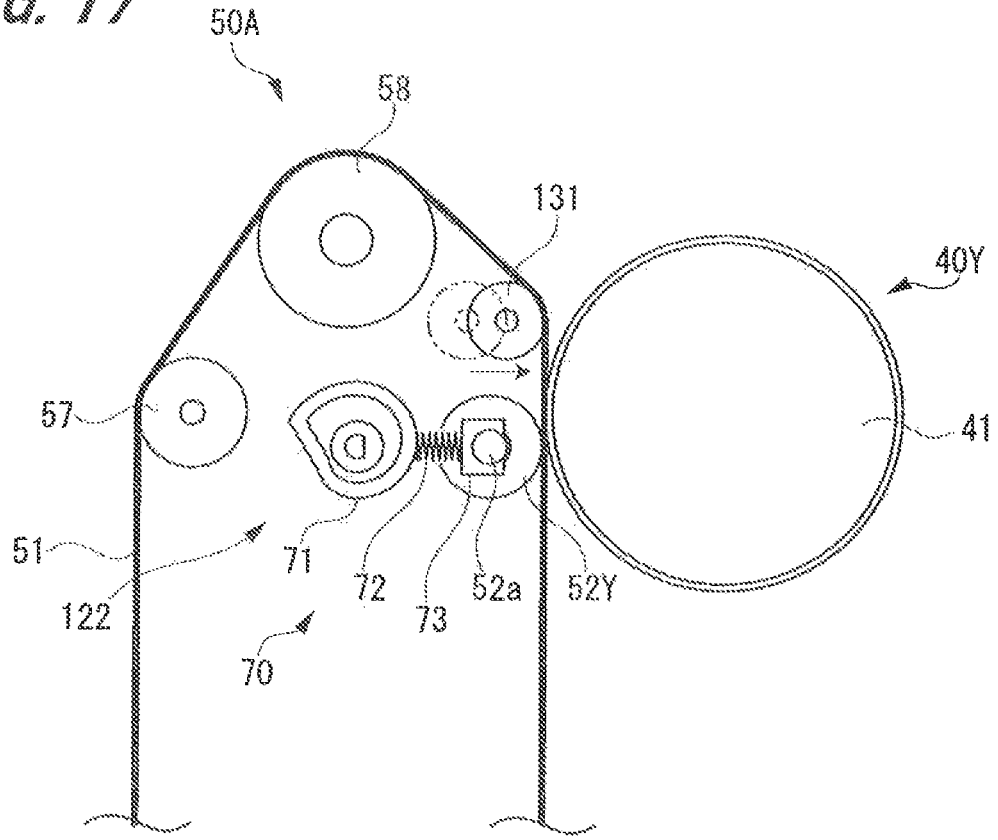
FIG. 17 is a schematic elevational view showing a primary portion of an intermediate transfer unit of an image forming apparatus according to a second embodiment of the present invention.

FIG. 17 is a schematic elevational view showing a primary portion of an intermediate transfer unit of an image forming apparatus according to a second embodiment of the present invention.

An intermediate transfer unit 50A according to the present embodiment has a pressing roller 131 adapted to press the intermediate transfer belt 51 toward the image forming units 40Y, 40M, 40C, 40K. The CPU 101 drive-controls a pressing roller moving mechanism (not shown) to move the pressing roller 131 to a released position (shown by the broken line) or to an image forming position (shown by the solid line). The pressing roller 131 is moved to the image forming position, so that the intermediate transfer belt 51 comes into contact with the photoreceptor 41 (i.e., the image forming apparatus is brought into an image forming state). In the image forming state, the CPU 101 drive-controls the four primary transfer pressure adjusting cams 71 rotate to set angles. Thus, the primary transfer pressure of each primary transfer roller applied in each primary transfer nip between the intermediate transfer belt 51 and the photoreceptor 41 is suitably adjusted.

With such a configuration, since it is possible to bias the primary transfer pressure by pressing the intermediate transfer belt 51 with the pressing roller 131, the change of the radius of the primary transfer pressure adjusting cam with its rotation can be reduced, and the primary transfer pressure can be finely adjusted.

According to the aforesaid embodiments of the present invention, the transfer pressure between the intermediate transfer belt and the photoreceptor in the width direction of the intermediate transfer belt can be kept uniform even in a state where the belt tension becomes non-uniform between the proximal side and the distal side. Thus, excellent image with no toner concentration gradient in the width direction of the intermediate transfer belt can be formed.

It is to be understood that the present invention is not limited to the embodiments described above, and various modifications and applications can be made without departing from the spirit and scope of the present invention.

For example, in the aforesaid first and second embodiments, the belt according to the present invention is applied to the intermediate transfer belt; however, the belt according to the present invention may also be applied to a conveying belt adapted to convey the sheet to the transfer section.

What is claimed is:

1. An image forming apparatus, comprising:

an image forming section having a photoreceptor on which a toner image is formed;

an endless belt that revolves with its outer surface facing the photoreceptor;

a steering roller adapted to provide a tension to the belt and adjust the position of the belt in the width direction;

a transfer roller that presses the belt toward the photoreceptor so as to form a transfer nip where the toner image is transferred;

a transfer pressure adjusting mechanism adapted to adjust pressing force when the transfer roller presses the belt toward the photoreceptor; and a controller adapted to control the pressing force adjusted by the transfer pressure adjusting mechanism, according to the adjustment state of the steering roller, wherein the transfer pressure adjusting mechanism changes the tilt of a rotating shaft of the transfer roller with respect to the width direction of the belt.

2. An image forming apparatus, comprising:

an image forming section having a photoreceptor on which a toner image is formed;

an endless belt that revolves with its outer surface facing the photoreceptor;

a steering roller adapted to provide a tension to the belt and adjust the position of the belt in the width direction;

a transfer roller that presses the belt toward the photoreceptor so as to form a transfer nip where the toner image is transferred;

a transfer pressure adjusting mechanism adapted to adjust pressing force when the transfer roller presses the belt toward the photoreceptor;

a controller adapted to control the pressing force adjusted by the transfer pressure adjusting mechanism, according to the adjustment state of the steering roller; and a storage adapted to store control amount of the transfer pressure adjusting mechanism with respect to the adjustment state of the steering roller, wherein the controller controls the operation of the transfer pressure adjusting mechanism based on the control amount of the transfer pressure adjusting mechanism with respect to the adjustment state of the steering roller stored in the storage.

3. The image forming apparatus according to claim 2, further comprising:

a toner concentration difference detector adapted to detect toner concentration difference after transferring toner in the width direction of the belt, wherein the controller changes the adjustment state of the steering roller, measures the control amount of the transfer pressure adjusting mechanism for each different adjustment state in the case where the toner concentration difference after transferring toner detected by the toner concentration difference detector is equal to or less than a threshold, creates a correction table in which the adjustment state of the steering roller is associated with the control amount of the transfer pressure adjusting mechanism, and stores the correction table in the storage.

4. The image forming apparatus according to claim 3, wherein the controller causes, based on the correction table, the steering roller and the transfer pressure adjusting mechanism to operate, compares the toner concentration difference after transferring toner detected by the toner concentration difference detector with the toner concentration difference after transferring toner obtained when creating the correction table for each adjustment state of the steering roller and control amount of the transfer pressure adjusting mechanism, and modifies, according to the difference of the both, the control amount of the transfer pressure adjusting mechanism with respect to the adjustment state of the steering roller in the correction table.

5. The image forming apparatus according to claim 3, wherein the toner concentration difference detector detects the concentration difference of the toner transferred to the belt in the width direction of the belt.

6. The image forming apparatus according to claim 3, wherein the toner concentration difference detector detects the concentration difference of the toner transferred to a sheet in the width direction of the belt.

* * * * *